US010539888B2

(12) United States Patent
Kaku et al.

(10) Patent No.: US 10,539,888 B2
(45) Date of Patent: Jan. 21, 2020

(54) ELECTROPHOTOGRAPHIC PHOTOSENSITIVE MEMBER, PROCESS CARTRIDGE, AND ELECTROPHOTOGRAPHIC APPARATUS

(71) Applicant: CANON KABUSHIKI KAISHA, Tokyo (JP)

(72) Inventors: Kenichi Kaku, Suntou-gun (JP); Kaname Watariguchi, Yokohama (JP); Kazuko Araki, Tokyo (JP); Tomohito Ishida, Suntou-gun (JP); Michiyo Sekiya, Atami (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 16/007,871

(22) Filed: Jun. 13, 2018

(65) Prior Publication Data

US 2019/0004442 A1 Jan. 3, 2019

(30) Foreign Application Priority Data

Jun. 29, 2017 (JP) ..... 2017-127999

(51) Int. Cl.

| | |
|---|---|
| ***G03G 5/147*** | (2006.01) |
| ***G03G 5/047*** | (2006.01) |
| ***G03G 5/05*** | (2006.01) |

(52) U.S. Cl.

CPC ..... *G03G 5/047* (2013.01); *G03G 5/0539* (2013.01); *G03G 5/0553* (2013.01); *G03G 5/0592* (2013.01); *G03G 5/14743* (2013.01); *G03G 5/14786* (2013.01)

(58) Field of Classification Search

CPC ..... G03G 5/147; G03G 5/14708; G03G 5/14726; G03G 5/1473

See application file for complete search history.

(56) References Cited

U.S. PATENT DOCUMENTS

| | | | | |
|---|---|---|---|---|
| 2003/0180646 | A1* | 9/2003 | Asano | G03G 5/005 430/125.3 |
| 2008/0031642 | A1* | 2/2008 | Yamada | G03G 5/0514 399/25 |
| 2010/0196817 | A1* | 8/2010 | Sasaki | G03G 9/0819 430/109.4 |
| 2015/0241803 | A1* | 8/2015 | Ikari | G03G 5/14 430/56 |

FOREIGN PATENT DOCUMENTS

| | | | |
|---|---|---|---|
| EP | 1383009 | A2 | 1/2004 |
| JP | 2009229742 | A | 10/2009 |
| JP | 2010204136 | A | 9/2010 |
| JP | 2013257416 | A | 12/2013 |

* cited by examiner

*Primary Examiner* — Peter L Vajda

(74) *Attorney, Agent, or Firm* — Canon U.S.A., Inc. IP Division

(57) ABSTRACT

An electrophotographic photosensitive member includes an electroconductive support member and a photosensitive layer. The uppermost layer of the electrophotographic photosensitive member defines a surface layer, and the surface layer contains polytetrafluoroethylene particles, a charge transporting material, and polyvinyl acetal. The proportion of the polyvinyl acetal content to the polytetrafluoroethylene particles content in the surface layer is in the range of 0.1% by mass to 15.0% by mass, and the charge transporting material content in the surface layer is 35% by mass or more relative to the total mass of the surface layer.

6 Claims, 1 Drawing Sheet

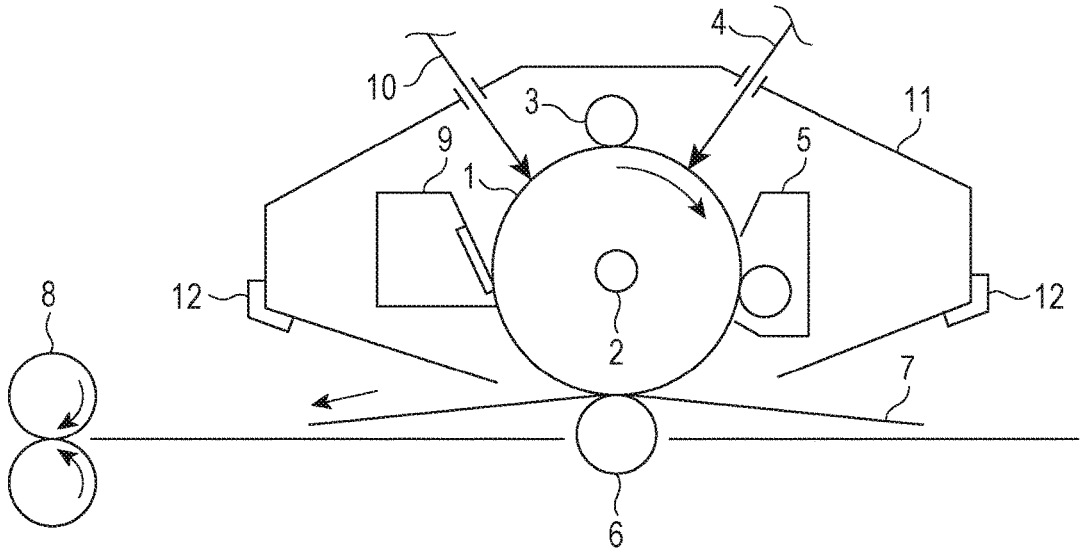
4
10
3
11
9
5
1
8
12
12
2
7
6

ELECTROPHOTOGRAPHIC PHOTOSENSITIVE MEMBER, PROCESS CARTRIDGE, AND ELECTROPHOTOGRAPHIC APPARATUS

BACKGROUND

Field of the Disclosure

The present disclosure relates to an electrophotographic photosensitive member, and a process cartridge and an electrophotographic apparatus that include the electrophotographic photosensitive member.

Description of the Related Art

In order to improve the image quality of electrostatic latent images formed on an electrophotographic photosensitive member, a charge transporting material is often added into the surface layer of the electrophotographic photosensitive member. Also, it has been known that polytetrafluoroethylene particles are added into the surface layer of the electrophotographic photosensitive member from the viewpoint of facilitating the removal of toner from the electrophotographic photosensitive member (Japanese Patent Laid-Open No. 2010-204136). This document discloses an electrophotographic photosensitive member including a charge transport layer containing polytetrafluoroethylene particles and a fluorine-containing graft polymer having a fluoroalkyl group.

Japanese Patent Laid-Open No. 2013-257416 discloses an electrophotographic photosensitive member having an outermost layer containing fluorine-containing particles, a polycarbonate or a polyarylate resin, and a polyvinyl acetal resin acting as a dispersion stabilizer.

SUMMARY

According to an aspect of the present disclosure, there is provided an electrophotographic photosensitive member including an electroconductive support member and a photosensitive layer. The uppermost layer of the electrophotographic photosensitive member defines a surface layer, and the surface layer contains polytetrafluoroethylene particles, a charge transporting material, and polyvinyl acetal. The proportion of the polyvinyl acetal content to the polytetrafluoroethylene particles content in the surface layer is in the range of 0.1% by mass to 15.0% by mass, and the charge transporting material content in the surface layer is 35% by mass or more relative to the total mass of the surface layer.

Also, an electrophotographic apparatus is provided. The electrophotographic apparatus includes the above-described electrophotographic photosensitive member, a charging device, an exposure device, a developing device, and a transfer device.

A process cartridge is provided. The cartridge can removably be attached to an electrophotographic apparatus, which contains the electrophotographic photosensitive member, at least one device selected from the group consisting of a charging device, a developing device, a transfer device, and a cleaning device, the at least one device being held together with the electrophotographic photosensitive member in one body.

The present disclosure further provides the electrophotographic photosensitive capable of forming images having high discrete dot reproductivity, and the process cartridge and the electrophotographic apparatus that include the electrophotographic photosensitive member.

Further features of the present disclosure will become apparent from the following description of exemplary embodiments with reference to the attached drawing.

BRIEF DESCRIPTION OF THE DRAWINGS

The sole FIGURE is a schematic view of the structure of an electrophotographic apparatus provided with a process cartridge including an electrophotographic photosensitive member according to an embodiment of the present disclosure.

DESCRIPTION OF THE EMBODIMENTS

According to a study by the present inventors, the known electrophotographic photosensitive member having a surface layer containing polytetrafluoroethylene particles has not always produced satisfactory image quality when repeatedly used in low-humidity environment. This is probably because the polytetrafluoroethylene particles are charged by friction with the toner or any other member. If the surface layer contains polytetrafluoroethylene particles together with a charge transporting material, as disclosed in the above-cited Japanese Patent Laid-Open No. 2010-204136, charges of the charge transporting material migrate to the polytetrafluoroethylene particles. Thus, the polytetrafluoroethylene particles are likely to be further charged. The present inventors assume that this causes the Coulomb force between the toner and the surface layer of the electrophotographic photosensitive member to act improperly to hinder the toner from removing from the electrophotographic photosensitive member. In this case, the discrete dot reproductivity of the output image is not satisfactory. This is a technical issue.

Accordingly, the present disclosure provides an electrophotographic photosensitive member that allows the toner to be easily removed therefrom and can form images having high discrete dot reproductivity even though the surface layer of the electrophotographic photosensitive member contains polytetrafluoroethylene particles and a charge transporting material together. The present disclosure also provides a process cartridge and an electrophotographic apparatus that include the electrophotographic photosensitive member.

The subject matter of the present disclosure will be described in detail in the following exemplary embodiments.

The present inventors have found, through their studies, that by adding a polyvinyl acetal in a specific proportion (0.1% by mass to 15.0% by mass relative to the mass of the polytetrafluoroethylene particles) to the surface layer of an electrophotographic photosensitive member, the electrophotographic photosensitive member allows easy removal of the toner therefrom.

The present inventors assume that the reason why such an electrophotographic photosensitive member can form images having high discrete dot reproductivity is as described follow. The polyvinyl acetal added to the surface layer in a proportion of 0.1% by mass or more to the mass of the polytetrafluoroethylene particles acts to reduce the chargeability of the polytetrafluoroethylene particles, thus preventing the polytetrafluoroethylene particles from being charged by friction with the toner or any other member. However, if the proportion of the polyvinyl acetal is increased, the transport charges are trapped by the polyvinyl acetal around the charge transporting material, and charge hopping among the molecules of the charge transporting material is suppressed. Consequently, the resulting image does not have satisfactory discrete dot reproductivity. According to a study by the present inventors, it is desirable that the proportion of the polyvinyl acetal to the polytetrafluoroethylene particles be 15.0% by mass or less. Also, the present inventors confirmed that when the charge transporting material content in the surface layer relative to the total mass of the surface layer is 35% by mass or more, the transport charges are not easily trapped, and that accordingly discrete dot reproductivity is increased.

Synergistic interaction between components or members of the electrophotographic photosensitive member produces beneficial effects as intended, as described above.

Electrophotographic Photosensitive Member

The electrophotographic photosensitive member disclosed herein includes an electroconductive support member and a photosensitive member. The surface layer of the electrophotographic photosensitive member satisfies specific conditions.

The surface layer mentioned herein refers to the uppermost layer of the electrophotographic photosensitive member and may be a part or the entirety of the photosensitive layer or a further layer disposed over the photosensitive layer.

The electrophotographic photosensitive member may be produced by applying each of the coating liquids prepared for forming the respective layers, which will be described later, in a desired order, and drying the coatings. Each coating liquid may be applied by dip coating, spray coating, ink jet coating, roll coating, die coating, blade coating, curtain coating, wire bar coating, ring coating, or any other method. In an embodiment, dip coating may be employed from the viewpoint of efficiency and productivity.

The layers of the electrophotographic photosensitive member will now be described.

Electroconductive Support Member

The electrophotographic photosensitive member disclosed herein includes an electroconductive support member (hereinafter simply referred to as the support member). The support member may be in the form of a hollow cylinder, a belt, a sheet, or the like. A hollow cylindrical support member is beneficial. The support member may be surface-treated by electrochemical treatment, such as anodization, or blasting, or cutting.

The support member may be made of a metal, a resin, or glass.

For a metal support member, the metal may be selected from among aluminum, iron, nickel, copper, gold, stainless steel, and alloys thereof. An aluminum support member is beneficial.

If the support member is made of a resin or glass, an electrically conductive material may be added into or applied over the support member to impart an electrical conductivity.

Electroconductive Layer

An electroconductive layer may be disposed on the support member. The electroconductive layer covers the surface flaw or surface roughness of the support member and reduces reflection of light from the surface of the support member.

The electroconductive layer may contain electrically conductive particles and a resin.

The material of the electrically conductive particles may be a metal oxide, a metal, carbon black, or the like.

Examples of the metal oxide include zinc oxide, aluminum oxide, indium oxide, silicon oxide, zirconium oxide, tin oxide, titanium oxide, magnesium oxide, antimony oxide, and bismuth oxide. Examples of the metal include aluminum, nickel, iron, nichrome, copper, zinc, and silver.

In some embodiments, the electroconductive particles may be made of a metal oxide, such as titanium oxide, tin oxide, or zinc oxide.

If metal oxide particles are used as the electrically conductive particles, these particles may be surface-treated with a silane coupling agent or the like or doped with an element such as phosphorus or aluminum or oxide thereof.

The electrically conductive particles may include core particles and coating layers coating the respective particles. The core particles may be made of titanium oxide, barium sulfate, zinc oxide, or the like. The coating layer may be made of a metal oxide, such as tin oxide.

If metal oxide particles are used as the electrically conductive particles, the metal oxide particles may have a volume average particle size in the range of 1 nm to 500 nm, for example, in the range of 3 nm to 400 nm.

The resin contained in the electroconductive layer may be polyester resin, polycarbonate resin, polyvinyl acetal resin, acrylic resin, silicone resin, epoxy resin, melamine resin, polyurethane resin, phenol resin, or alkyd resin.

The electroconductive layer may further contain an opacity agent, such as silicone oil, resin particles, or titanium oxide.

The thickness of the electroconductive layer may be in the range of 1 μm to 50 μm, for example, in the range of 3 μm to 40 μm.

The electroconductive layer may be formed by applying an electroconductive layer-forming coating liquid containing the above-described ingredients and a solvent to form a coating film, followed by drying. The solvent of the coating liquid may be an alcohol-based solvent, a sulfoxide-based solvent, a ketone-based solvent, an ether-based solvent, an ester-based solvent, or an aromatic hydrocarbon. The electrically conductive particles are dispersed in the electroconductive layer-forming coating liquid by using, for example, a paint shaker, a sand mill, a ball mill, or a high-speed liquid collision disperser.

Undercoat Layer

An undercoat layer may be disposed on the support member or the electroconductive layer. The undercoat layer enhances the adhesion between layers and blocks the injection of charges.

The undercoat layer may contain a resin. The undercoat layer may be a cured film formed by polymerizing a composition containing a monomer having a polymerizable functional group.

Examples of the resin contained in the undercoat layer include polyester resin, polycarbonate resin, polyvinyl acetal resin, acrylic resin, epoxy resin, melamine resin, polyurethane resin, phenol resin, polyvinylphenol resin, alkyd resin, polyvinyl alcohol resin, polyethylene oxide resin, polypropylene oxide resin, polyamide resin, polyamide acid resin, polyimide resin, poly(amide-imide) resin, and cellulose resin.

Examples of the polymerizable functional group of the monomer include an isocyanate group, blocked isocyanate groups, a methylol group, alkylated methylol groups, an epoxy group, metal alkoxide groups, a hydroxyl group, an amino group, a carboxy group, a thiol group, a carboxy anhydride group, and a carbon-carbon double bond.

The undercoat layer may further contain an electron transporting material, a metal oxide, a metal, or an electrically conductive polymer from the viewpoint of increasing the electrical properties. In an embodiment, an electron transporting material or a metal oxide may be added.

Examples of the electron transporting material include quinone compounds, imide compounds, benzimidazole compounds, cyclopentadienylidene compounds, fluorenone compounds, xanthone compounds, benzophenone compounds, cyanovinyl compounds, halogenated aryl compounds, silole compounds, and boron-containing compounds. The undercoat layer may be a cured film formed by copolymerizing an electron transporting material having a polymerizable functional group with the above-described monomer having a polymerizable functional group.

Examples of the metal oxide added to the undercoat layer include indium tin oxide, tin oxide, indium oxide, titanium oxide, zinc oxide, aluminum oxide, and silicon dioxide. The metal added to the undercoat layer may be gold, silver, or aluminum.

The undercoat layer may further contain an additive.

The average thickness of the undercoat layer may be in the range of 0.1 μm to 50 μm, for example, 0.2 μm to 40 μm or 0.3 μm to 30 μm.

The undercoat layer may be formed by applying an undercoat layer-forming coating liquid containing the above-described ingredients and a solvent to form a coating film, followed by drying and/or curing. The solvent of the undercoat layer-forming coating liquid may be an alcohol-based solvent, a ketone-based solvent, an ether-based solvent, an ester-based solvent, or an aromatic hydrocarbon.

Photosensitive Layer

The photosensitive layer may be: (1) a multilayer photosensitive layer; or (2) a single-layer photosensitive layer. (1) The multilayer photosensitive layer includes a charge generating layer containing a charge generating material, and a charge transport layer containing a charge transporting material. (2) The single-layer photosensitive layer is a photosensitive layer containing a charge generating material and a charge transporting material together.

In the embodiments in which the surface layer is the photosensitive layer, the surface layer may be: the charge transport layer containing a charge transporting material of (1) a multilayer photosensitive layer; or the photosensitive layer containing a charge generating material and a charge transporting material together in the singly-layer structure of a (2) single-layer photosensitive layer.

(1) Multilayer Photosensitive Layer

The multilayer photosensitive layer includes a charge generating layer and a charge transport layer.

(1-1) Charge Generating Layer

The charge generating layer may contain a charge generating material and a resin.

Examples of the charge generating material include azo pigments, perylene pigments, polycyclic quinone pigments, indigo pigments, and phthalocyanine pigments. Among these, azo pigments and phthalocyanine pigments are beneficial. An oxytitanium phthalocyanine pigment, a chlorogallium phthalocyanine pigment, or a hydroxygallium phthalocyanine pigment may be used as the phthalocyanine pigment.

The charge generating material content in the charge generating layer may be in the range of 40% by mass to 85% by mass, for example, in the range of 60% by mass to 80% by mass, relative to the total mass of the charge generating layer.

Examples of the resin contained in the charge generating layer include polyester resin, polycarbonate resin, polyvinyl acetal resin, polyvinyl butyral resin, acrylic resin, silicone resin, epoxy resin, melamine resin, polyurethane resin, phenol resin, polyvinyl alcohol resin, cellulose resin, polystyrene resin, polyvinyl acetate resin, and polyvinyl chloride resin. Among these, polyvinyl butyral resin is beneficial.

The charge generating layer may further contain an antioxidant, a UV absorbent, or any other additive. Examples of such an additive include hindered phenol compounds, hindered amine compounds, sulfur compounds, phosphorus compounds, and benzophenone compounds.

The thickness of the charge generating layer may be in the range of 0.1 μm to 1 μm, for example, in the range of 0.15 μm to 0.4 μm.

The charge generating layer may be formed by applying a coating liquid containing the above-described ingredients and a solvent to form a coating film, followed by drying. The solvent of the coating liquid may be an alcohol-based solvent, a sulfoxide-based solvent, a ketone-based solvent, an ether-based solvent, an ester-based solvent, or an aromatic hydrocarbon.

(1-2) Charge Transport Layer

The charge transport layer may contain a charge transporting material and a resin. In an embodiment of the present disclosure, the charge transport layer containing the charge transporting material may define the surface layer.

Examples of the charge transporting material include polycyclic aromatic compounds, heterocyclic compounds, hydrazone compounds, styryl compounds, enamine compounds, benzidine compounds, triarylamine compounds, and resins having a group derived from these compounds. Triarylamine compounds and benzidine compounds are beneficial. In some embodiments, the charge transporting material may be selected from among the following compounds:

(CTM-1)

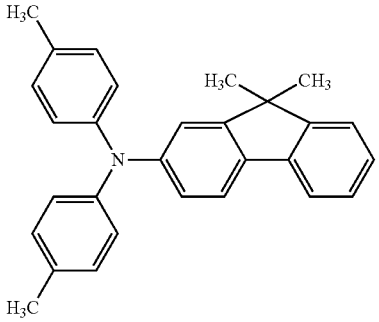

(CTM-2)

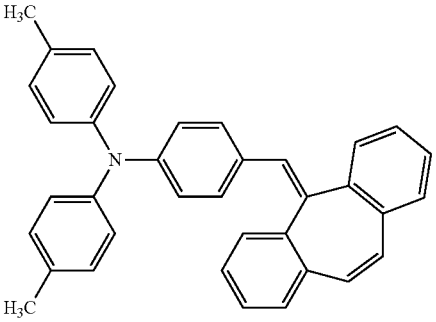

-continued
(CTM-3)
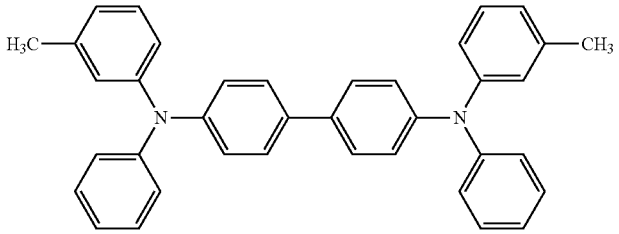
(CTM-4)
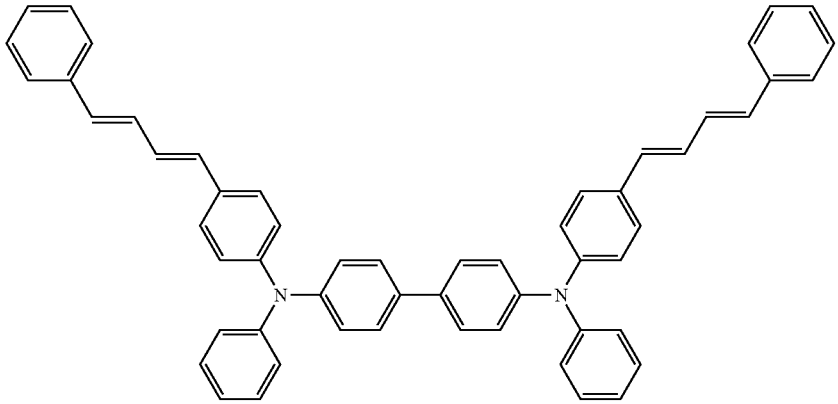
(CTM-5)
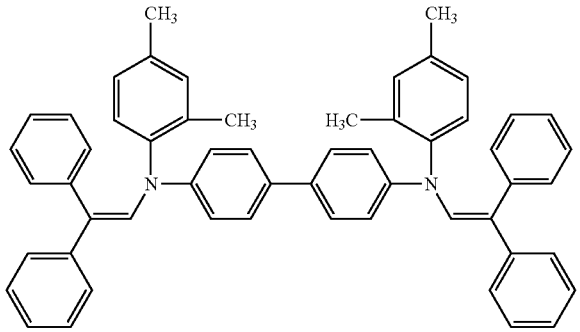
(CTM-6)
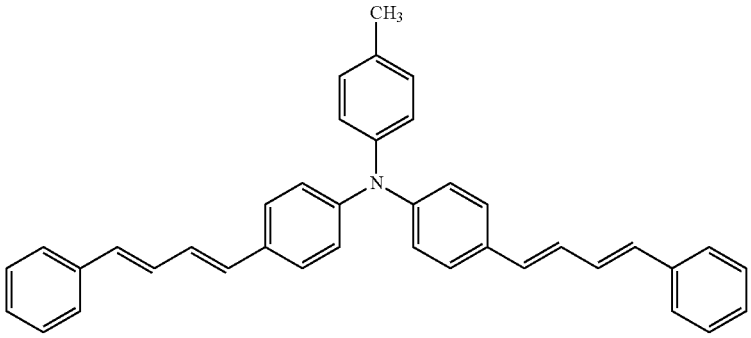

-continued (CTM-7)

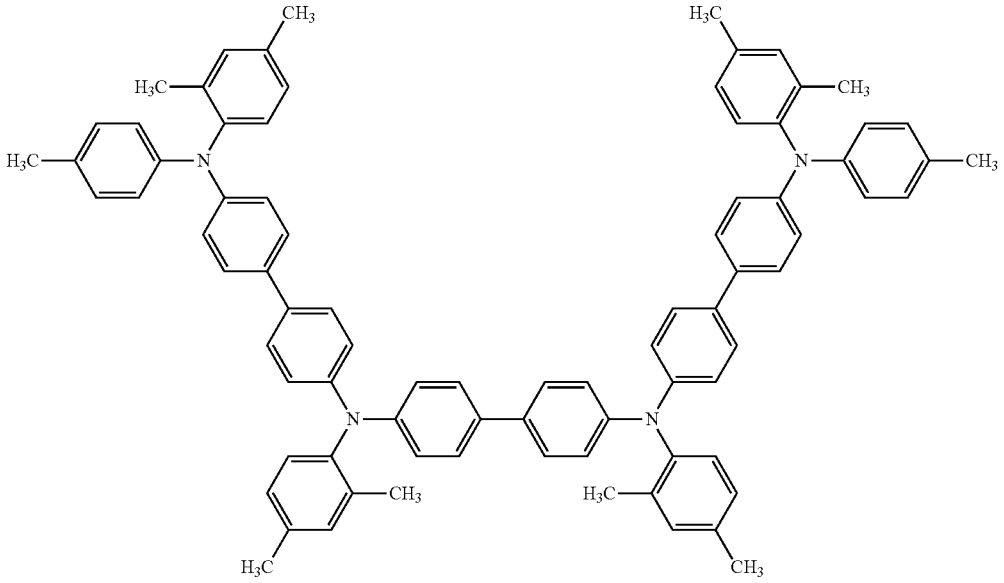

(CTM-8)

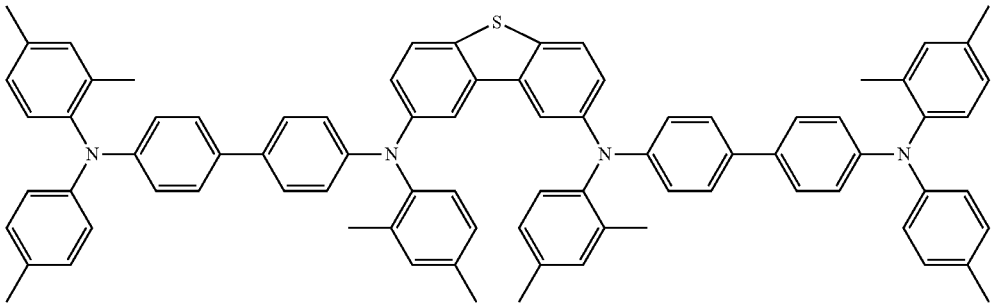

(CTM-9)

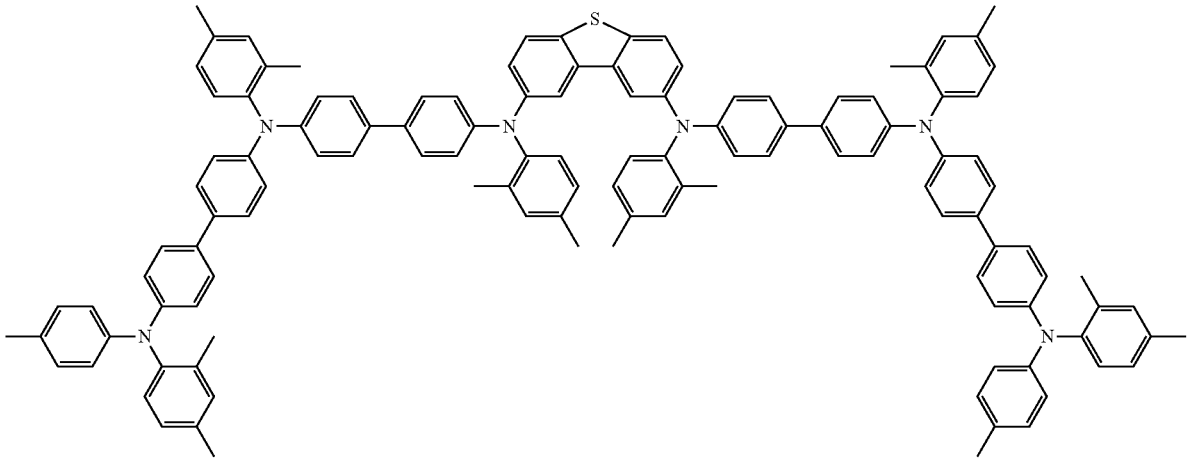

The charge transporting material content in the charge transport layer may be in the range of 35% by mass to 70% by mass relative to the total mass of the charge transport layer.

The resin contained in the charge transport layer may be a polyester resin, a polycarbonate resin, an acrylic resin, or a polystyrene resin. In an embodiment, a polycarbonate resin or a polyester resin may be used. For example, a polyarylate resin may be used as the polyester resin.

The mass ratio of the charge transporting material to the resin may be in the range of 4:10 to 20:10, for example, 5:10 to 12:10.

The charge transport layer may further contain an antioxidant, a UV absorbent, a plasticizer, a leveling agent, a lubricant, an abrasion resistance improver, and any other additive. More specifically, examples of such an additive include hindered phenol compounds, hindered amine compounds, sulfur compounds, phosphorus compounds, benzophenone compounds, siloxane-modified resin, silicone oil, fluororesin particles, polystyrene resin particles, polyethylene resin particles, silica particles, alumina particles, and boron nitride particles.

The average thickness of the charge transport layer may be in the range of 5 μm to 50 μm, for example, 8 μm to 40 μm or 10 μm to 30 μm.

The charge transport layer may be formed by applying a charge transport layer-forming coating liquid containing the above-described ingredients and a solvent to form a coating film, followed by drying. The solvent of the charge transport layer-forming coating liquid may be an alcohol-based solvent, a ketone-based solvent, an ether-based solvent, an ester-based solvent, or an aromatic hydrocarbon. In an embodiment, an ether-based solvent or an aromatic hydrocarbon may be used as the solvent.

(2) Single-Layer Photosensitive Layer

The single-layer photosensitive layer may be formed by applying a coating liquid containing a charge generating material, a charge transporting material, a resin, and a solvent to form a coating film, followed by drying. The charge generating material, the charge transporting material, and the resin may be selected from among the same materials cited in "(1) Multilayer Photosensitive Layer".

Protective Layer

The photosensitive layer may be covered with a protective layer. The protective layer enhances durability. If the surface layer is a further layer disposed over the photosensitive layer, the protective layer may be the surface layer containing a charge transporting material.

Examples of the charge transporting material that may be added to the protective layer include polycyclic aromatic compounds, heterocyclic compounds, hydrazone compounds, styryl compounds, enamine compounds, benzidine compounds, triarylamine compounds, and resins having a group derived from these compounds. Triarylamine compounds and benzidine compounds are beneficial.

The protective layer may further contain a resin. Examples of the resin contained in the protective layer include polyester resin, acrylic resin, phenoxy resin, polycarbonate resin, polystyrene resin, phenol resin, melamine resin, and epoxy resin. In an embodiment, a polycarbonate resin, a polyester resin, or an acrylic resin may be used.

The protective layer may be a cured film formed by polymerizing a composition containing a monomer having a polymerizable functional group. In this instance, a thermal polymerization reaction, a photopolymerization reaction, a radiation polymerization reaction, or the like may be conducted. The polymerizable functional group of the monomer may be an acryloyl group or a methacryloyl group. The monomer having a polymerizable functional group may have a charge transporting function. Beneficially, the protective layer is a cured film of a composition containing a charge transporting material having a polymerizable functional group.

The protective layer may further contain an antioxidant, a UV absorbent, a plasticizer, a leveling agent, a lubricant, an abrasion resistance improver, and any other additive. More specifically, examples of such an additive include hindered phenol compounds, hindered amine compounds, sulfur compounds, phosphorus compounds, benzophenone compounds, siloxane-modified resin, silicone oil, fluororesin particles, polystyrene resin particles, polyethylene resin particles, silica particles, alumina particles, and boron nitride particles.

The thickness of the protective layer may be in the range of 0.5 μm to 10 μm, for example, in the range of 1 μm to 7 μm.

The protective layer may be formed by applying a coating liquid containing the above-described ingredients and a solvent to form a coating film, followed by drying and/or curing. The solvent of the coating liquid for the protective layer may be an alcohol-based solvent, a ketone-based solvent, an ether-based solvent, a sulfoxide-based solvent, an ester-based solvent, or an aromatic hydrocarbon.

Surface Layer

The surface layer of the electrophotographic photosensitive member contains polytetrafluoroethylene particles, a charge transporting material, and polyvinyl acetal. Beneficially, the surface layer does not contain electrically conductive particles.

Polyvinyl Acetal

The polyvinyl acetal used herein is a ternary polymer composed of vinyl butyral, vinyl acetate, and vinyl alcohol and is produced by a reaction of polyvinyl alcohol with butyl aldehyde, thus having a structure including a butyral group, an acetyl group, and a hydroxy group. By varying the proportions of these three groups, the excessive electrification or charge of the polytetrafluoroethylene particles caused by a repetitive electrophotographic process can be controlled.

The mole percent of the hydroxy group in the polyvinyl acetal may be in the range of 25% to 40%. When the mole percent of the hydroxy group is in such a range, the polytetrafluoroethylene particles are prevented effectively from being excessively charged or from aggregating while the surface layer is being formed.

The polyvinyl acetal may be selected from among S-LEC B series, S-LEC K (KS) series, and S-LEC SV series (each produced by Sekisui Chemical) and Mowital series (produced by Kuraray). More specifically, examples of the polyvinyl acetal include S-LEC B series, such as BM-1 (hydroxy group: 34 mol %, butyralization degree: 65 mol %±3 mol %, molecular weight: 40000), BH-3 (hydroxy group: 34 mol %, butyralization degree: 65 mol %±3 mol %, molecular weight: 110000), BH-6 (hydroxy group: 30 mol %, butyralization degree: 69 mol %±3 mol %, molecular weight: 920000), BX-1 (hydroxy group: 33 mol %±3 mol %, acetalization degree: 66 mol %, molecular weight: 100000), BX-5 (hydroxy group: 33 mol %±3 mol %, acetalization degree: 66 mol %, molecular weight: 130000), BM-2 (hydroxy group: 31 mol %, butyralization degree: 68 mol %±3 mol %, molecular weight: 520000), BM-5 (hydroxy group: 34 mol %, butyralization degree: 65 mol %±3 mol %, molecular weight: 530000), BL-1 (hydroxy group: 36 mol %, butyralization degree: 63 mol %±3 mol %, molecular weight: 190000), BL-1H (hydroxy group: 30 mol %, butyralization degree: 69 mol %±3 mol %, molecular weight: 20000), BL-2 (hydroxy group: 36 mol %, butyralization degree: 63 mol %±3 mol %, molecular weight: 270000), BL-2H (hydroxy group: 29 mol %, butyralization degree: 70 mol %±3 mol %, molecular weight: 280000), BL-10 (hydroxy group: 28 mol %, butyralization degree: 71 mol %±3 mol %, molecular weight: 150000), and BL-S (hydroxy group: 22 mol %, butyralization degree: 74 mol %±3 mol %, molecular weight: 23000); S-LEC KS-10 (hydroxy group: 25 mol %, acetalization degree: 65 mol %±3 mol %, molecular weight: 170000); and Mowital series, such as B145 (hydroxy group: 21 mol % to 27 mol %, acetalization degree: 67 mol % to 75 mol %) and B16H (hydroxy group: 26 mol % to 31 mol %, acetalization degree: 66 mol % to 74 mol %, molecular weight: 10000 to 20000). These polyvinyl acetals may be used singly or in combination.

In the surface layer of the photoelectric photosensitive member disclosed herein, the proportion of the polyvinyl acetal content to the polytetrafluoroethylene particles content is in the range of 0.1% by mass to 15.0% by mass. In an embodiment, the proportion of the polyvinyl acetal content to the polytetrafluoroethylene particles content may be in the range of 3.0% by mass to 12.0% by mass or 5.0% by mass to 10.0% by mass.

From the viewpoint of achieving the subject matter having intended effects, it is beneficial to distribute the polyvinyl acetal around the polytetrafluoroethylene particles. Accordingly, in an embodiment, the polytetrafluoroethylene particles and the polyvinyl acetal are added to the surface layer under a condition or by a procedure where the polyvinyl acetal can coat the polytetrafluoroethylene particles in advance, rather than simply added together. For example, the polytetrafluoroethylene particles are added into and stirred with a solution of the polyvinyl acetal in an organic solvent, and then, a shearing force is applied to the mixture by using a bead mill or any other dispersion device. Thus, the polytetrafluoroethylene particles are uniformly dispersed while being coated with the polyvinyl acetal. Then, the charge transporting material is added and dissolved in the resulting dispersion liquid, and the thus prepared composition is applied to the photosensitive layer to form the surface layer. This is a beneficial process to form the surface layer containing polyvinyl acetal-coated polytetrafluoroethylene particles.

The organic solvent of the polyvinyl acetal solution in which the polytetrafluoroethylene particles are dispersed is not particularly limited and is a solvent that can dissolve the polyvinyl acetal to a desired concentration and dissolve also the charge transporting material and the resin that will be added in the subsequent step for forming the surface layer.

The thickness of the polyvinyl acetal layer coating the polytetrafluoroethylene particles may be in the range of 1 nm to 50 nm or 3 nm to 30 nm. In an embodiment, the thickness may be in the range of 5 nm to 20 nm.

The proportion of the polyvinyl acetal content to the charge transporting material content may be 10% or less, for example, 6% or less. The presence of the polyvinyl acetal around the polytetrafluoroethylene particles can prevent excessive electrification or charge of the polytetrafluoroethylene particles in a repetitive electrophotographic process. However, if the polyvinyl acetal is excessively added, the polyvinyl acetal acts as a trap that suppresses the charge hopping among the molecules of the charge transporting material. Therefore, the proportion of the polyvinyl acetal may be controlled in the above range.

Polytetrafluoroethylene Particles

The average primary particle size of the polytetrafluoroethylene particles added to the surface layer may be in the range of 40 nm to 400 nm or 40 nm to 200 nm. In an embodiment, the average primary particles size may be in the range of 50 nm to 100 nm. From the viewpoint of facilitating the removal of the toner particles from the surface layer of the photosensitive member, polytetrafluoroethylene particles having an average primary particle size of 50 nm or more may be used. However, polytetrafluoroethylene particles having an average primary particles size larger than 100 nm may scatter irradiation light, consequently degrading the quality of discrete dots in the resulting image.

The content of the polytetrafluoroethylene particles in the surface layer may be in the range of 1% by mass to 40.0% by mass, for example, 10.0% by mass to 30.0% by mass, relative to the total mass of the surface layer.

From the viewpoint of preventing the aggregation of the polytetrafluoroethylene particles in the surface layer, the surface layer may contain a polymer having a fluoroalkyl group. The proportion of this polymer to the polytetrafluoroethylene particles in the surface layer may be in the range of 3.0% by mass to 10.0% by mass.

Antifoaming Agent

The surface layer may further contain an antifoaming agent. If the polytetrafluoroethylene particles are used in the form of a dispersion liquid of polytetrafluoroethylene particles with a high concentration of, for example, 30% by mass, the dispersion liquid tens to foam. Adding an antifoaming agent is beneficial.

The antifoaming agent used in the surface layer is appropriately selected depending on the combination with the solvent from a variety of antifoaming agents including those of silicone-based or fluorosilicone-based emulsion type, self-emulsifying type, oil type, oil compound type, solution type, powder type, and solid type. In an embodiment, a hydrophilic or a water-soluble silicone-based antifoaming agent may be used from the viewpoint of allowing the antifoaming agent to be present at the interface between the solvent used as a non-aqueous organic solvent and air rather than between the solvent and the polytetrafluoroethylene particles. However, the selection of the antifoaming agent is not particularly limited to this. The antifoaming agent content depends on the polytetrafluoroethylene particles content (concentration) in the dispersion liquid and other factors and may be 1% by mass or less relative to the total mass of the dispersion liquid.

Charge Transport Material

When the charge transport layer defines the surface layer, any of the following charge transporting materials may be used:

(CTM-1)

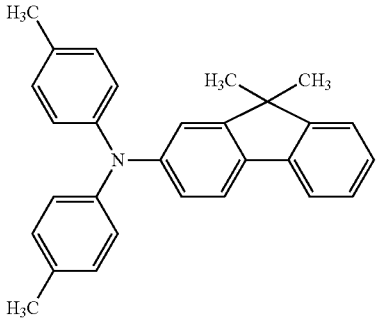

(CTM-2)

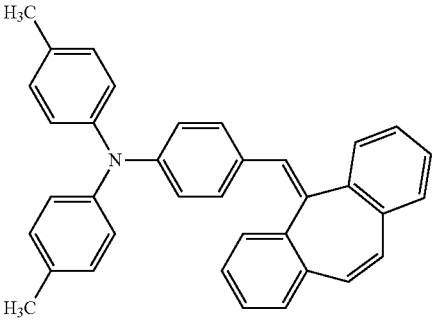

-continued
(CTM-3)
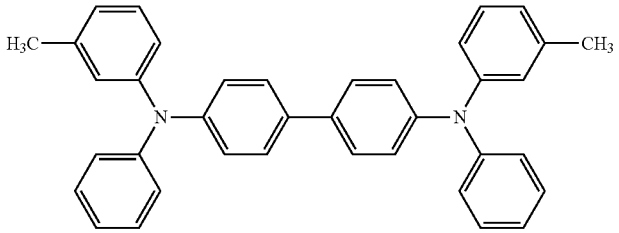
(CTM-4)
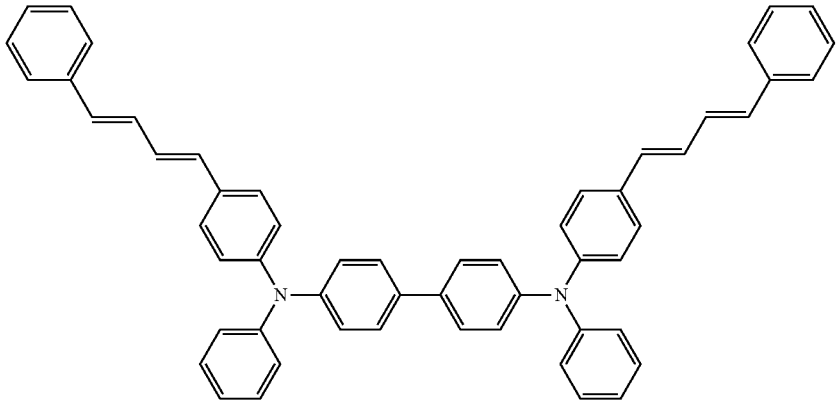
(CTM-5)
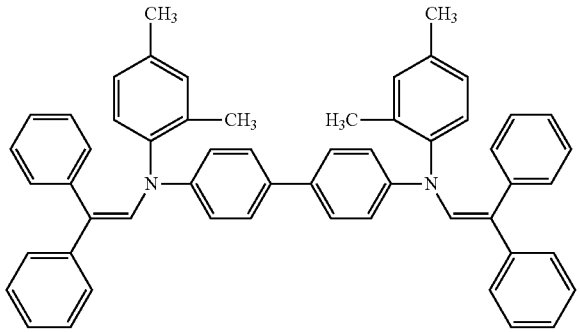
(CTM-6)
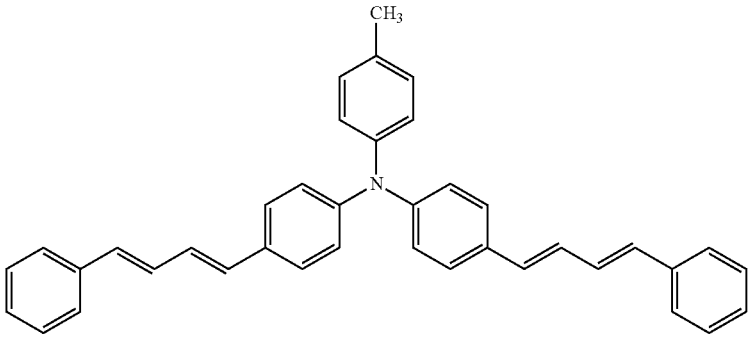

-continued (CTM-7)

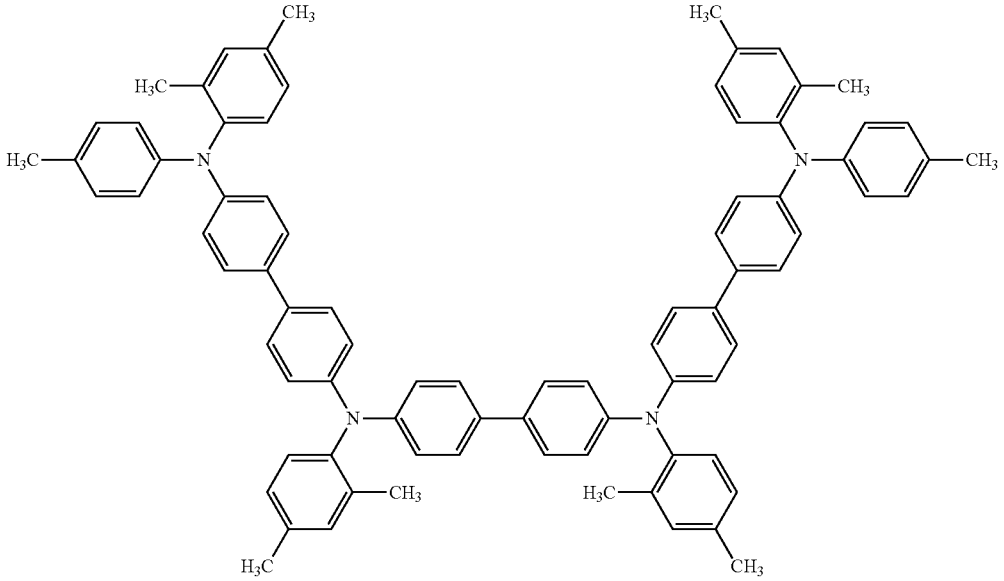

(CTM-8)

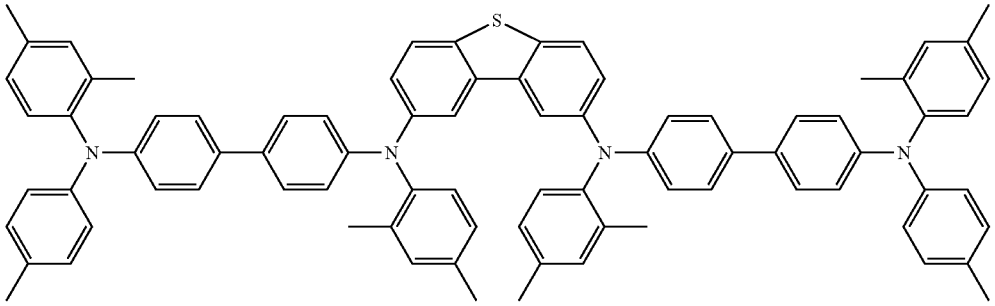

(CTM-9)

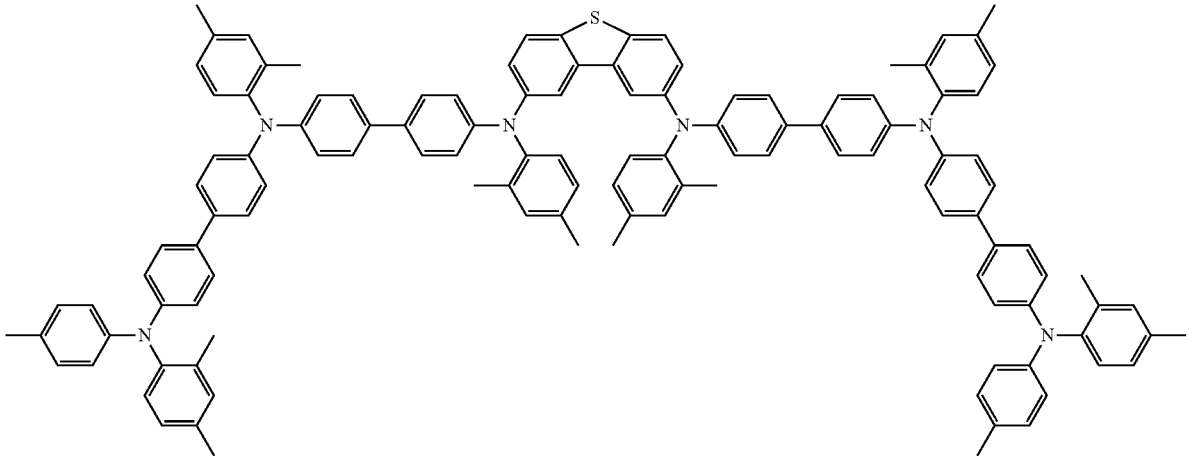

When a protective layer defines the surface layer, the protective layer may contain a binder resin having a polymerizable functional group or a monomer (reactive monomer) or oligomer having a polymerizable functional group, and a charge transporting compound having a polymerizable reactive group. The surface protective layer is formed by curing these ingredients. For the curing, light, heat, or radiation (for example, electron beam) may be used. In an embodiment, the surface protective layer may be a cured product of a charge transporting compound having a chain polymerizable functional group, not containing a resin or monomer or oligomer having no charge-transporting functional group.

Examples of the chain-polymerizable functional group include acryloyloxy, methacryloyloxy, alkoxysilyl, and epoxy. An acryloyloxy or a methacryloyloxy group may be beneficially used.

Examples of the charge transporting compound include:
(H-1)
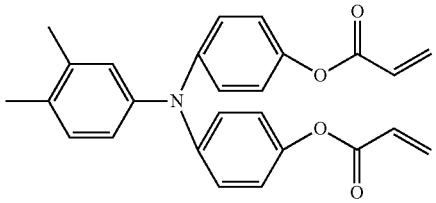
(H-2)
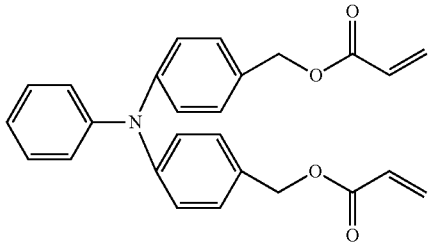
(H-3)
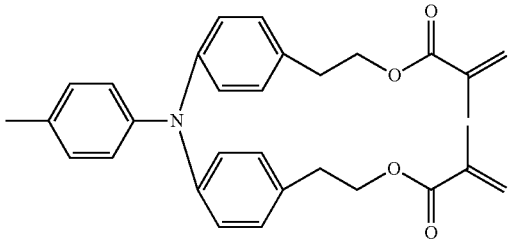
(H-4)
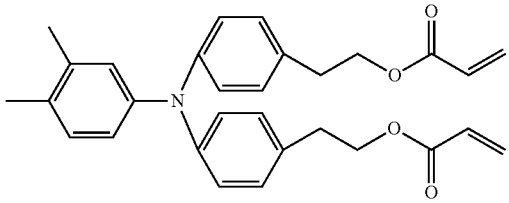
(H-5)
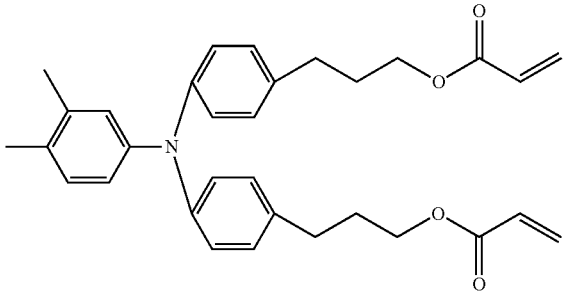
(H-6)
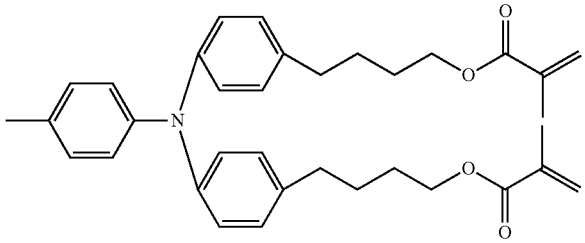
(H-7)
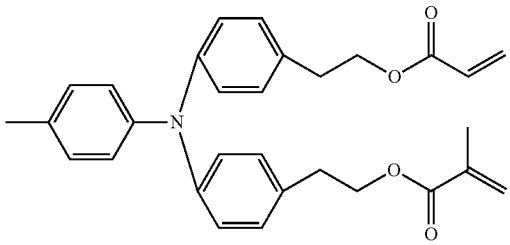
(H-8)
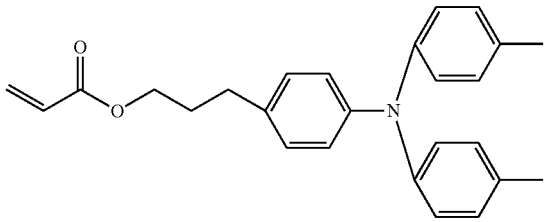
(H-9)
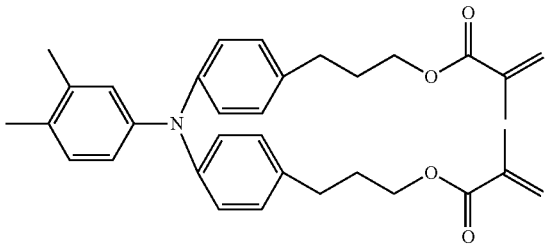
(H-10)
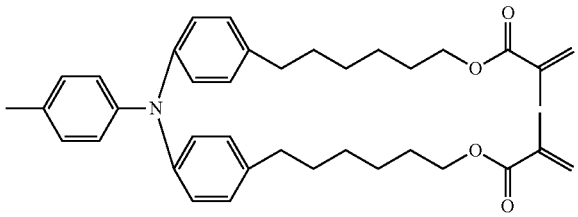

-continued (H-11)

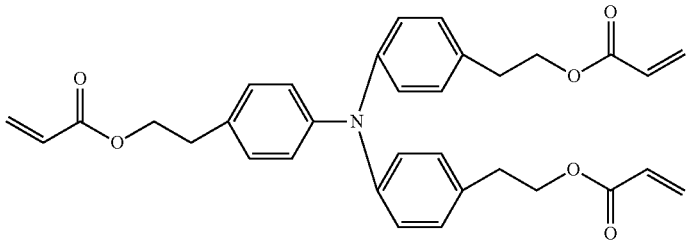

(H-12)

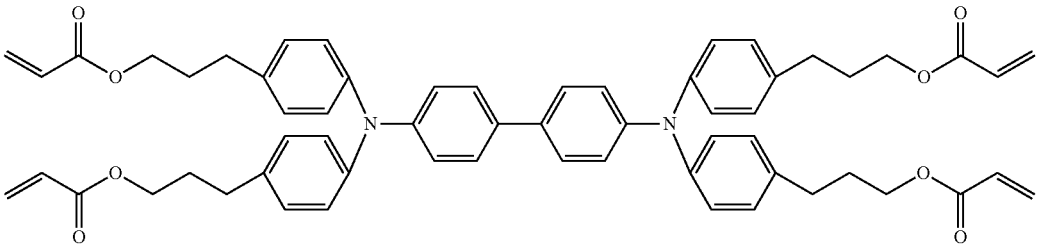

(H-13)

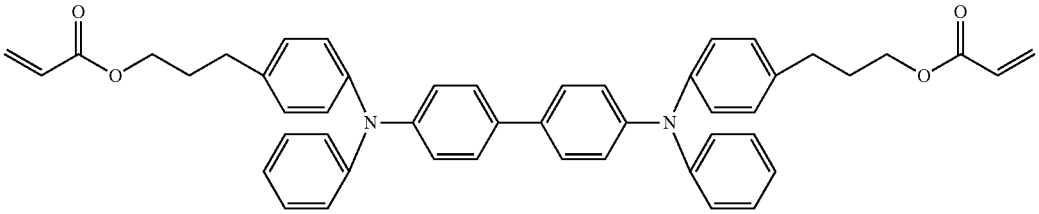

(H-14)

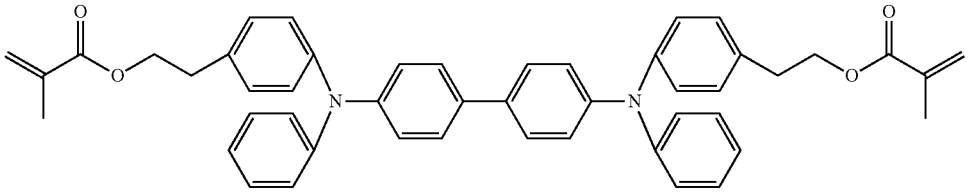

The charge transporting material content in the surface layer may be 35% by mass or more, for example, 60% by mass, relative to the total mass of the surface layer.

The binder resin having a polymerizable functional group is a binder resin having a functional group polymerizable with the above-described charge transporting compound having a polymerizable functional group and is not otherwise limited. For example, a binder resin having any one of the following structures may be used:

(J-1)

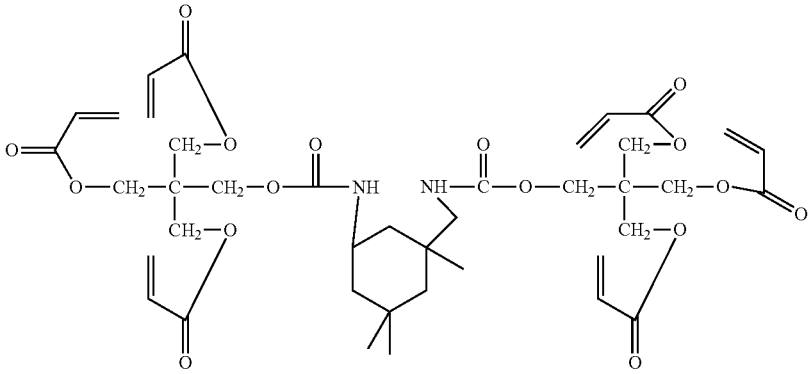

-continued
(J-2)
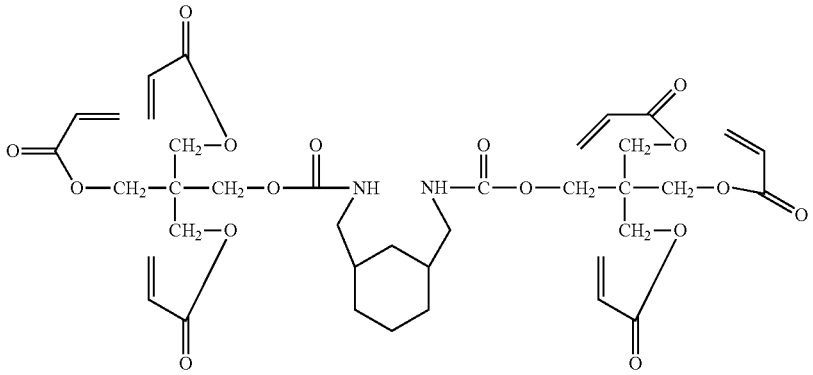
(J-3)
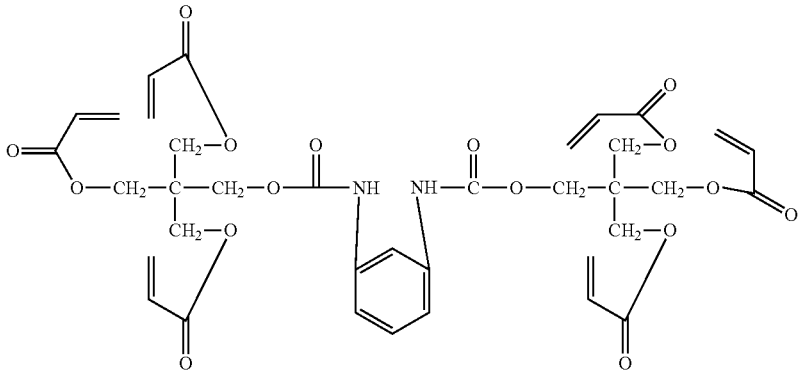
(J-4)
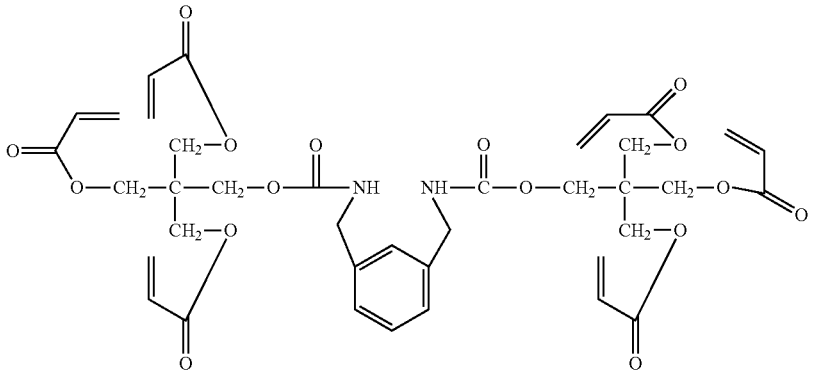
(J-5)
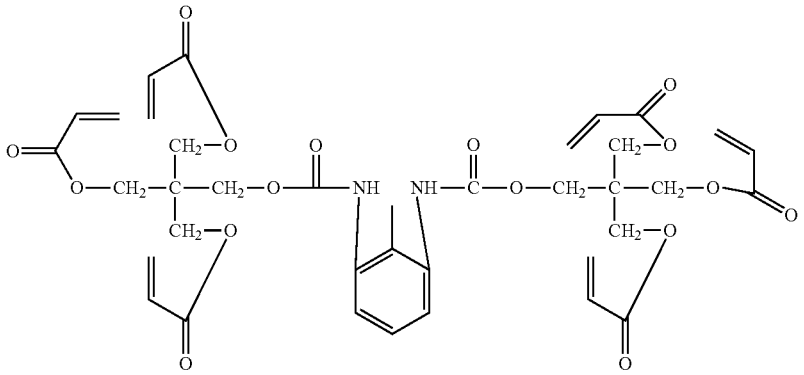

-continued
(J-6)
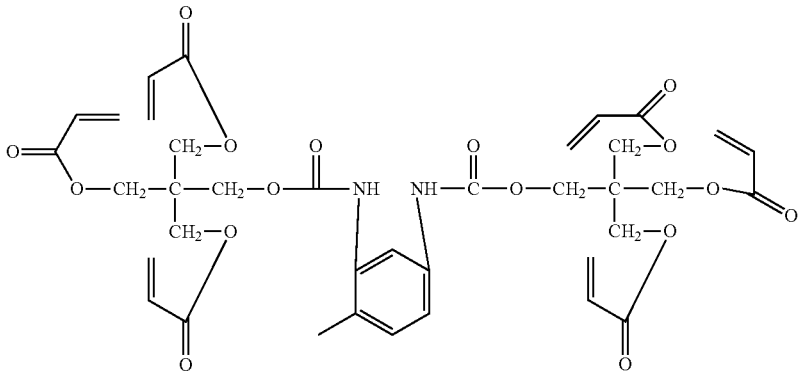
(J-7)
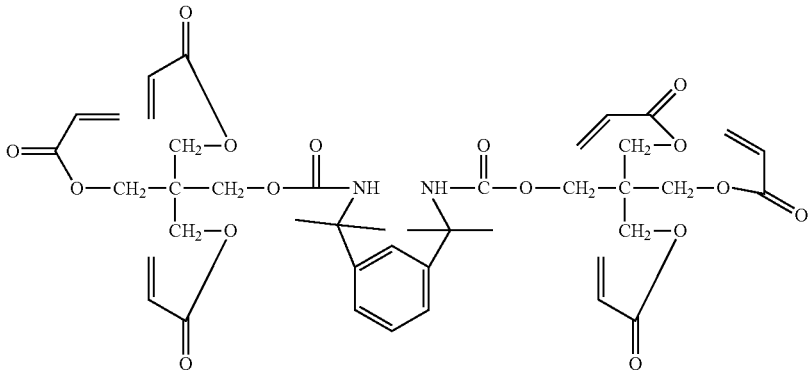
(J-8)
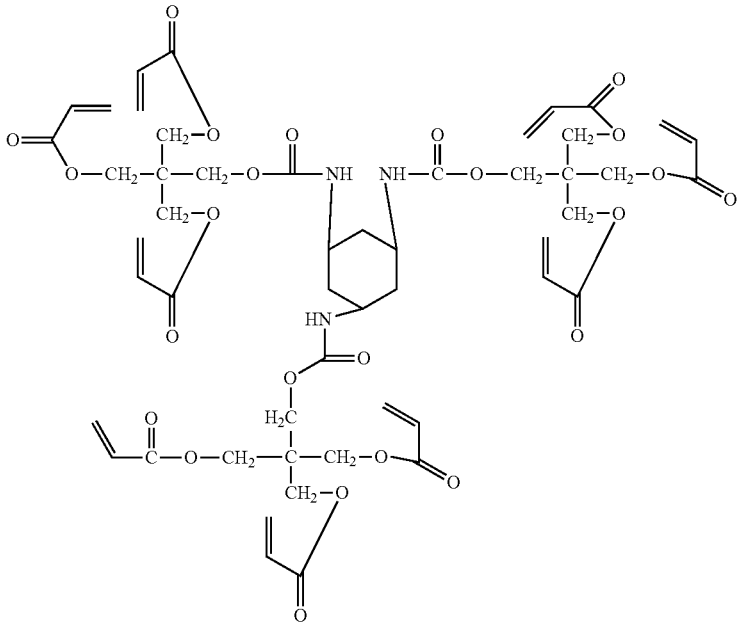

-continued (J-9)

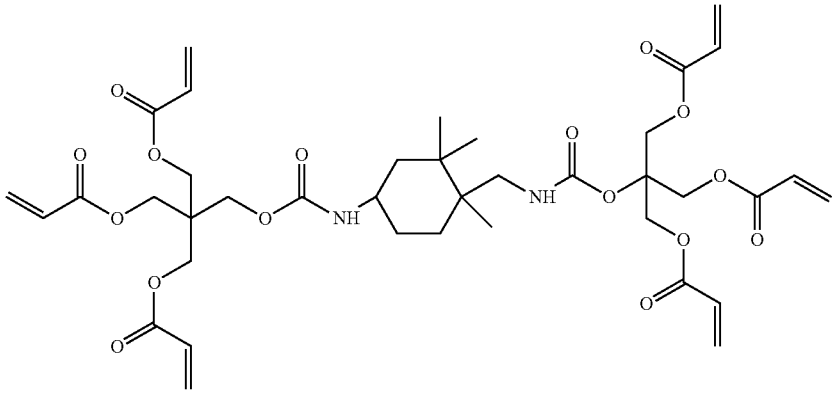

Process Cartridge and Electrophotographic Apparatus

The process cartridge according to an embodiment of the present disclosure is removably mounted in an electrophotographic apparatus and includes the above-described electrophotographic photosensitive member and at least one device selected from the group consisting of a charging device, a developing device, a transfer device, and a cleaning device. The electrophotographic photosensitive member and these devices are held in one body.

Also, the electrophotographic apparatus according to an embodiment of the present disclosure includes the above-described electrophotographic photosensitive member, a charging device, an exposure device, a developing device, and a transfer device.

The FIGURE is a schematic view of the structure of an electrophotographic apparatus provided with a process cartridge including an electrophotographic photosensitive member.

The electrophotographic photosensitive member designated by reference numeral 1 is hollow and cylindrical and is driven for rotation on an axis 2 in the direction indicated by an arrow at a predetermined peripheral speed. The surface of the electrophotographic photosensitive member 1 is charged to a predetermined positive or negative potential with a charging device 3. Although the charging device 3 is of roller type for roller charging in the embodiment shown in the FIGURE, the charging device 3 may be a type for corona charging, proximity charging, injection charging, or the like in another embodiment. An electrostatic latent image corresponding to targeted image information is formed on the surface of the charged electrophotographic photosensitive member 1 by irradiation with exposure light 4 from an exposure device (not shown). The electrostatic latent image formed on the surface of the electrophotographic photosensitive member 1 is developed into a toner image with a toner contained in a developing device 5. The toner image on the surface of the electrophotographic photosensitive member 1 is transferred to a transfer medium 7 by a transfer device 6. The transfer medium 7 to which the toner image has been transferred is conveyed to a fixing device 8 and fixed by the fixing device 8, thus being ejected as an output image from the electrophotographic apparatus. The electrophotographic apparatus may include a cleaning device 9 for removing toner or the like remaining on the electrophotographic photosensitive member 1 after transfer. Alternatively, what is called a cleanerless system in which the developing device or the like acts to remove the toner or the like may be implemented without using a cleaning device. The electrophotographic apparatus may include a static elimination mechanism operable to remove static electricity from the surface of the electrophotographic photosensitive member 1 with pre-exposure light 10 from a pre-exposure device (not shown). Also, the electrophotographic apparatus may have a guide 12, such as a rail, that guides the removal or attachment of the process cartridge.

The electrophotographic photosensitive member of the present disclosure may be used in a laser beam printer, an LED printer, a copy machine, a facsimile, or a multifunctional machine having functions of those apparatuses.

EXAMPLES

The subject matter of the present disclosure will be further described in detail with reference to Examples and Comparative Examples. The subject matter is however not limited to the following Examples. In the following Examples, "part(s)" is on a mass basis unless otherwise specified.

Preparation of Electrophotographic Photosensitive Members

Example 1

An aluminum cylinder of 24 mm in diameter and 257 mm in length was used as a support member (electroconductive support member).

Then, a dispersion liquid was prepared from the following materials:

metal oxide particles: 214 parts of titanium oxide ($TiO_2$) particles coated with oxygen-deficient tin oxide ($SnO_2$);

binder resin: 132 parts of phenol resin (phenol resin monomer/oligomer) Plyophen J-325 (produced by DIC, resin solids content: 60% by mass); and solvent: 98 parts of l-methoxy-2-propanol.

These ingredients were blended in a sand mill containing 450 parts of glass beads of 0.8 mm in diameter at a rotational speed of 2000 rpm for 4.5 hours with cooling water set to 18° C., thus yielding the dispersion liquid. Then, the glass beads were removed from the dispersion liquid through a mesh (openings: 150 μm).

Silicone resin particles Tospearl 120 (manufactured by Momentive Performance Materials, average particle size: 2 μm) were added as a surface roughening agent into the dispersion liquid. The proportion of the silicone resin particles at this time was adjusted to 10% by mass relative to the total mass of the metal oxide particles and the binder in the dispersion liquid from which the glass beads had been removed. Also, a silicone oil (SH28PA produced by Dow Corning Toray) was added as a leveling agent into the dispersion liquid in a proportion of 0.01% by mass relative to the total mass of the metal oxide particles and the binder in the dispersion liquid, and the mixture was stirred to yield a coating liquid for forming an electroconductive layer.

This coating liquid was applied to the surface of the support member by dip coating. The resulting coating film was dried and cured by heating at 150° C. for 30 minutes to yield a 30 μm-thick electroconductive layer.

Subsequently, 15 parts of N-methoxymethylated 6-nylon resin Tresin EF-30T (produced by Nagase Chemtex) and 5 parts of a copolymerized nylon resin Amilan CM8000 (produced by Toray) were dissolved in a mixed solvent of 220 parts of methanol and 110 parts of 1-butanol to yield a coating liquid for forming an undercoat layer. This coating liquid was applied onto the surface of the electroconductive layer by dip coating. The resulting coating film was dried at 100° C. for 10 minutes to yield a 0.65 μm-thick undercoat layer.

Next, 2 parts of a polyvinyl butyral S-LEC BX-1 (produced by Sekisui Chemical) was dissolved in 100 parts of cyclohexanone. To the resulting solution was added 4 parts of crystalline hydroxygallium phthalocyanine (charge generating material) whose CuKα X-ray diffraction spectrum has strong peaks at Bragg angle 2θ of 7.4°±0.2° and 28.1°±0.2°. The ingredients were uniformly blended for dispersion at 23° C.±3° C. for 1 hour in a sand mill containing glass beads of 1 mm in diameter. After this blending, 100 parts of ethyl acetate was added to the dispersion to yield a coating liquid for forming a charge generating layer. This coating liquid was applied onto the undercoat layer by dip coating. The resulting coating film was dried at 90° C. for 10 minutes to yield a 0.20 μm-thick charge generating layer.

Subsequently, a coating liquid for forming a charge transport layer was prepared by dissolving 60 parts of the compound represented by formula (CTM-1), 30 parts of the compound represented by formula (CTM-3), 10 parts of the compound represented by formula (CTM-2), 100 parts of a polycarbonate IUPILON Z400 (bisphenol Z polycarbonate produced by Mitsubishi Engineering-Plastics), and 0.2 part of a polycarbonate having the structural unit represented by the following formula (E) (viscosity average molecular weight Mv: 20000) in the mixed solvent of 260 parts of o-xylene and 240 parts of methyl benzoate.

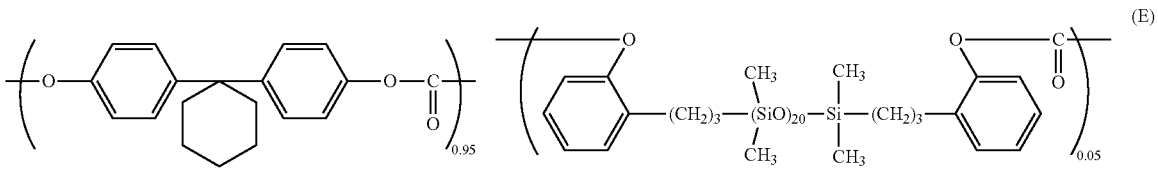

(E)

The coating liquid for the charge transport layer was applied onto the surface of the charge generating layer by dip coating. The resulting coating film was dried at 125° C. for 30 minutes to yield a 12.0 μm-thick charge transport layer.

Preparation of Polytetrafluoroethylene Particle Dispersion Liquid for Surface Layer In the mixed solvent of 48.5 parts of isopropanol and 20 parts of 1-butanol was fully dissolved 1.5 parts of a polyvinyl acetal S-LEC BL-10 (produced by Sekisui Chemical, hydroxy group: 28 mol %, butyralization degree: 71 mol %±3 mol %, molecular weight: about 15000) with stirring. Then, 30 parts of polytetrafluoroethylene particles having an average particle size of 200 nm were added into the solution with stirring to yield a mixture. The polytetrafluoroethylene particles in the mixture were dispersed in a bead mill containing zirconia beads of 0.3 mm in diameter, and 0.1 part of a silicone antifoaming agent KM-72 (produced by Shin-Etsu Chemical) was added to the dispersion to yield a polytetrafluoroethylene particle dispersion liquid.

Preparation of Surface Layer-Forming Coating Liquid

Subsequently, 70 parts of a hole-transporting compound represented by formula (H-5) shown above, 30 parts of 1,1,2,2,3,3,4-heptafluorocyclopentane, and 30 parts of 1-propanol were added to the polytetrafluoroethylene particle dispersion liquid to yield a mixture. The mixture was filtered through a Polyflon filter (PF-040, manufactured by ADVANTEC) to yield a coating liquid for forming a surface layer.

Formation of Surface Layer

The surface layer-forming coating liquid was applied onto the charge transport layer by dip coating, and the coating film was dried at 60° C. for 5 minutes. After being dried, the coating film was irradiated with electron beam radiation at an acceleration voltage of 70 kV and an absorption dose of 8000 Gy for 1.6 s in a nitrogen atmosphere. Then, the coating film was heat-treated in a nitrogen atmosphere for 1 minute under the condition where the coating film temperature came to 130° C. The oxygen concentration was 15 ppm in the steps from the electron beam irradiation to the 1-minute heat treatment. Subsequently, the coating film was heat-treated for 15 minutes in the air under the condition where the coating film temperature came to 110° C., thus yielding a 3 μm-thick surface layer.

Thus, an electrophotographic photosensitive member (OPC-1) was produced which includes the support member, the electroconductive layer, the undercoat layer, the charge generating layer, the charge transport layer, and the surface protective layer in this order.

Example 2

An electrophotographic photosensitive member (OPC-2) was produced in the same manner as in Example 1 except for the preparation of the polytetrafluoroethylene particle dispersion liquid. In this preparation, 1.5 parts of polyvinyl acetal and the mixed solvent of 48.5 parts of isopropanol and 20 parts of 1-butanol were varied in amount to 0.3 part of polyvinyl acetal, 49.7 parts of isopropanol, and 20 parts of 1-butanol.

Example 3

An electrophotographic photosensitive member (OPC-3) was produced in the same manner as in Example 1 except for the preparation of the polytetrafluoroethylene particle dispersion liquid. In this preparation, 1.5 parts of polyvinyl acetal and the mixed solvent of 48.5 parts of isopropanol and 20 parts of 1-butanol were varied in amount to 0.9 part of polyvinyl acetal, 49.1 parts of isopropanol, and 20 parts of 1-butanol.

Example 4

An electrophotographic photosensitive member (OPC-4) was produced in the same manner as in Example 1 except for the preparation of the polytetrafluoroethylene particle dispersion liquid. In this preparation, 1.5 parts of polyvinyl acetal and the mixed solvent of 48.5 parts of isopropanol and 20 parts of 1-butanol were varied in amount to 3 parts of polyvinyl acetal, 47 parts of isopropanol, and 20 parts of 1-butanol.

Example 5

An electrophotographic photosensitive member (OPC-2) was produced in the same manner as in Example 1 except for the preparation of the polytetrafluoroethylene particle dispersion liquid. In this preparation, 1.5 parts of polyvinyl acetal and the mixed solvent of 48.5 parts of isopropanol and 20 parts of 1-butanol were varied in amount to 4.5 parts of polyvinyl acetal, 45.5 parts of isopropanol, and 20 parts of 1-butanol.

Example 6

An electrophotographic photosensitive member (OPC-6) was produced in the same manner as in Example 1 except for the preparation of the polytetrafluoroethylene particle dispersion liquid. In this preparation, 1.5 parts of polyvinyl acetal and the mixed solvent of 48.5 parts of isopropanol and 20 parts of 1-butanol were varied in amount to 0.03 part of polyvinyl acetal, 49.97 parts of isopropanol, and 20 parts of 1-butanol.

Example 7

An electrophotographic photosensitive member (OPC-7) was produced in the same manner as in Example 1 except for using polytetrafluoroethylene particles having an average particle size of 100 nm, a polyvinyl acetal S-LEC BM-1 (polyvinyl acetal produced by Sekisui Chemical, hydroxy group: 34 mol %, butyralization degree: 65 mol %±3 mol %, molecular weight: 40000), and zirconia beads of 0.1 mm in diameter substituted for the zirconia beads of 0.3 mm in diameter.

Example 8

An electrophotographic photosensitive member (OPC-8) was produced in the same manner as in Example 2 except for using polytetrafluoroethylene particles having an average particle size of 100 nm, a polyvinyl acetal S-LEC BM-1 (polyvinyl acetal produced by Sekisui Chemical, hydroxy group: 34 mol %, butyralization degree: 65 mol %±3 mol %, molecular weight: 40000), and zirconia beads of 0.1 mm in diameter substituted for the zirconia beads of 0.3 mm in diameter.

Example 9

An electrophotographic photosensitive member (OPC-9) was produced in the same manner as in Example 3 except for using polytetrafluoroethylene particles having an average particle size of 100 nm, a polyvinyl acetal S-LEC BM-1 (polyvinyl acetal produced by Sekisui Chemical, hydroxy group: 34 mol %, butyralization degree: 65 mol %±3 mol %, molecular weight: 40000), and zirconia beads of 0.1 mm in diameter substituted for the zirconia beads of 0.3 mm in diameter.

Example 10

An electrophotographic photosensitive member (OPC-10) was produced in the same manner as in Example 4 except for using polytetrafluoroethylene particles having an average particle size of 100 nm, a polyvinyl acetal S-LEC BM-1 (polyvinyl acetal produced by Sekisui Chemical, hydroxy group: 34 mol %, butyralization degree: 65 mol %±3 mol %, molecular weight: 40000), and zirconia beads of 0.1 mm in diameter substituted for the zirconia beads of 0.3 mm in diameter.

Example 11

An electrophotographic photosensitive member (OPC-11) was produced in the same manner as in Example 5 except for using polytetrafluoroethylene particles having an average particle size of 100 nm, a polyvinyl acetal S-LEC BM-1 (polyvinyl acetal produced by Sekisui Chemical, hydroxy group: 34 mol %, butyralization degree: 65 mol %±3 mol %, molecular weight: 40000), and zirconia beads of 0.1 mm in diameter substituted for the zirconia beads of 0.3 mm in diameter.

Example 12

An electrophotographic photosensitive member (OPC-12) was produced in the same manner as in Example 6 except for using polytetrafluoroethylene particles having an average particle size of 100 nm, a polyvinyl acetal S-LEC BM-1 (polyvinyl acetal produced by Sekisui Chemical, hydroxy group: 34 mol %, butyralization degree: 65 mol %±3 mol %, molecular weight: 40000), and zirconia beads of 0.1 mm in diameter substituted for the zirconia beads of 0.3 mm in diameter.

Example 13

An electrophotographic photosensitive member (OPC-13) was produced in the same manner as in Example 1 except for using polytetrafluoroethylene particles having an average particle size of 50 nm, a polyvinyl acetal S-LEC BL-S (polyvinyl acetal produced by Sekisui Chemical, hydroxy group: 22 mol %, butyralization degree: about 74 mol %±3 mol %, molecular weight: 23000), and zirconia beads of 0.1 mm in diameter substituted for the zirconia beads of 0.3 mm in diameter.

Example 14

An electrophotographic photosensitive member (OPC-14) was produced in the same manner as in Example 2 except for using polytetrafluoroethylene particles having an average particle size of 50 nm, a polyvinyl acetal S-LEC BL-S (polyvinyl acetal produced by Sekisui Chemical, hydroxy group: 22 mol %, butyralization degree: about 74 mol %±3 mol %, molecular weight: 23000), and zirconia beads of 0.1 mm in diameter substituted for the zirconia beads of 0.3 mm in diameter.

Example 15

An electrophotographic photosensitive member (OPC-15) was produced in the same manner as in Example 3 except for using polytetrafluoroethylene particles having an average particle size of 50 nm, a polyvinyl acetal S-LEC BL-S (polyvinyl acetal produced by Sekisui Chemical, hydroxy group: 22 mol %, butyralization degree: about 74 mol %±3 mol %, molecular weight: 23000), and zirconia beads of 0.1 mm in diameter substituted for the zirconia beads of 0.3 mm in diameter.

Example 16

An electrophotographic photosensitive member (OPC-16) was produced in the same manner as in Example 4 except for using polytetrafluoroethylene particles having an average particle size of 50 nm, a polyvinyl acetal S-LEC BL-S (polyvinyl acetal produced by Sekisui Chemical, hydroxy group: 22 mol %, butyralization degree: about 74 mol %±3 mol %, molecular weight: 23000), and zirconia beads of 0.1 mm in diameter substituted for the zirconia beads of 0.3 mm in diameter.

Example 17

An electrophotographic photosensitive member (OPC-17) was produced in the same manner as in Example 5 except for using polytetrafluoroethylene particles having an average particle size of 50 nm, a polyvinyl acetal S-LEC BL-S (polyvinyl acetal produced by Sekisui Chemical, hydroxy group: 22 mol %, butyralization degree: about 74 mol %±3 mol %, molecular weight: 23000), and zirconia beads of 0.1 mm in diameter substituted for the zirconia beads of 0.3 mm in diameter.

Example 18

An electrophotographic photosensitive member (OPC-18) was produced in the same manner as in Example 6 except for using polytetrafluoroethylene particles having an average particle size of 50 nm, a polyvinyl acetal S-LEC BL-S (polyvinyl acetal produced by Sekisui Chemical, hydroxy group: 22 mol %, butyralization degree: about 74 mol %±3 mol %, molecular weight: 23000), and zirconia beads of 0.1 mm in diameter substituted for the zirconia beads of 0.3 mm in diameter.

Example 19

An electrophotographic photosensitive member (OPC-19) was produced in the same manner as in Example 1 except for using polytetrafluoroethylene particles having an average particle size of 300 nm and a polyvinyl acetal S-LEC BX-1 (polyvinyl acetal produced by Sekisui Chemical, hydroxy group: 33 mol %±3 mol %, acetalization degree: about 66 mol %, molecular weight: 100000).

Example 20

An electrophotographic photosensitive member (OPC-20) was produced in the same manner as in Example 2 except for using polytetrafluoroethylene particles having an average particle size of 300 nm and a polyvinyl acetal S-LEC BX-1 (polyvinyl acetal produced by Sekisui Chemical, hydroxy group: 33 mol %±3 mol %, acetalization degree: about 66 mol %, molecular weight: 100000).

Example 21

An electrophotographic photosensitive member (OPC-21) was produced in the same manner as in Example 3 except for using polytetrafluoroethylene particles having an average particle size of 300 nm and a polyvinyl acetal S-LEC BX-1 (polyvinyl acetal produced by Sekisui Chemical, hydroxy group: 33 mol %±3 mol %, acetalization degree: about 66 mol %, molecular weight: 100000).

Example 22

An electrophotographic photosensitive member (OPC-22) was produced in the same manner as in Example 4 except for using polytetrafluoroethylene particles having an average particle size of 300 nm and a polyvinyl acetal S-LEC BX-1 (polyvinyl acetal produced by Sekisui Chemical, hydroxy group: 33 mol %±3 mol %, acetalization degree: about 66 mol %, molecular weight: 100000).

Example 23

An electrophotographic photosensitive member (OPC-23) was produced in the same manner as in Example 5 except for using polytetrafluoroethylene particles having an average particle size of 300 nm and a polyvinyl acetal S-LEC BX-1 (polyvinyl acetal produced by Sekisui Chemical, hydroxy group: 33 mol %±3 mol %, acetalization degree: about 66 mol %, molecular weight: 100000).

Example 24

An electrophotographic photosensitive member (OPC-24) was produced in the same manner as in Example 6 except for using polytetrafluoroethylene particles having an average particle size of 300 nm and a polyvinyl acetal S-LEC BX-1 (polyvinyl acetal produced by Sekisui Chemical, hydroxy group: 33 mol %±3 mol %, acetalization degree: about 66 mol %, molecular weight: 100000).

Example 25

An electrophotographic photosensitive member (OPC-25) was produced in the same manner as in Example 1 except for the preparation of the polytetrafluoroethylene particle dispersion liquid. In this preparation, 1.5 parts of polyvinyl acetal and the mixed solvent of 48.5 parts of isopropanol and 20 parts of 1-butanol were varied in amount to 0.9 part of polyvinyl acetal, 49.1 parts of isopropanol, and 20 parts of 1-butanol.

Example 26

An electrophotographic photosensitive member (OPC-26) was produced in the same manner as in Example 1 except that 1.5 parts of polyvinyl acetal and the mixed solvent of 48.5 parts of isopropanol and 20 parts of 1-butanol used in the preparation of the polytetrafluoroethylene particle dispersion liquid were varied in amount to 3.6 parts of polyvinyl acetal, 46.4 parts of isopropanol, and 20 parts of 1-butanol, and that the zirconia beads of 0.3 mm in diameter were replaced with zirconia beads of 0.1 mm in diameter.

Example 27

An electrophotographic photosensitive member (OPC-27) was produced in the same manner as in Example 25 except for using polytetrafluoroethylene particles having an average particle size of 100 nm and a polyvinyl acetal S-LEC BM-1 (polyvinyl acetal produced by Sekisui Chemical, hydroxy group: 34 mol %, butyralization degree: 65 mol %±3 mol %, molecular weight: 40000).

Example 28

An electrophotographic photosensitive member (OPC-28) was produced in the same manner as in Example 26 except for using polytetrafluoroethylene particles having an average particle size of 100 nm and a polyvinyl acetal S-LEC BM-1 (polyvinyl acetal produced by Sekisui Chemical, hydroxy group: 34 mol %, butyralization degree: 65 mol %±3 mol %, molecular weight: 40000).

Example 29

An electrophotographic photosensitive member (OPC-29) was produced in the same manner as in Example 25 except for using polytetrafluoroethylene particles having an average particle size of 50 nm and a polyvinyl acetal S-LEC BL-S (polyvinyl acetal produced by Sekisui Chemical, hydroxy group: 22 mol %, butyralization degree: about 74 mol %±3 mol %, molecular weight: 23000).

Example 30

An electrophotographic photosensitive member (OPC-30) was produced in the same manner as in Example 26 except for using polytetrafluoroethylene particles having an average particle size of 50 nm and a polyvinyl acetal S-LEC BL-S (polyvinyl acetal produced by Sekisui Chemical, hydroxy group: 22 mol %, butyralization degree: about 74 mol %±3 mol %, molecular weight: 23000).

Comparative Example 1

An electrophotographic photosensitive member (OPC-C1) was produced in the same manner as in Example 1 except that polyvinyl acetal was not used.

Comparative Example 2

An electrophotographic photosensitive member (OPC-C2) was produced in the same manner as in Example 1 except for the preparation of the polytetrafluoroethylene particle dispersion liquid. In this preparation, 1.5 parts of polyvinyl acetal and the mixed solvent of 48.5 parts of isopropanol and 20 parts of 1-butanol were varied in amount to 6 parts of polyvinyl acetal, 44 parts of isopropanol, and 20 parts of 1-butanol.

Example 31

The layers up to the charge transport layer were formed in the same manner as in Example 1, and the surface layer was formed by using the following coating liquid.

Preparation of Polytetrafluoroethylene Particle Dispersion Liquid for Surface Layer In the mixed solvent of 48.5 parts of isopropanol and 20 parts of 1-butanol was fully dissolved 1.5 parts of a polyvinyl acetal S-LEC BM-1 (produced by Sekisui Chemical, hydroxy group: 34 mol %, butyralization degree: 65 mol %±3 mol %, molecular weight: 40000) with stirring. Then, 30 parts of polytetrafluoroethylene particles having an average particle size of 200 nm were added into the solution with stirring to yield a mixture. The polytetrafluoroethylene particles in the mixture were dispersed in a bead mill containing zirconia beads of 0.3 mm in diameter, and 0.1 part of a silicone antifoaming agent KM-72 (produced by Shin-Etsu Chemical) was added to the dispersion to yield a polytetrafluoroethylene particle dispersion liquid.

Preparation of Surface Layer-Forming Coating Liquid

Subsequently, 55 parts of a hole-transporting compound represented by the following formula (H-15), 13.5 parts of a non-charge-transporting compound represented by formula (J-1) shown above, 30 parts of 1,1,2,2,3,3,4-heptafluorocyclopentane, and 30 parts of 1-propanol were added to the polytetrafluoroethylene particle dispersion liquid to yield a mixture. The mixture was filtered through a Polyflon filter (PF-040, manufactured by ADVANTEC) to yield a coating liquid for forming a surface layer.

(H-15)

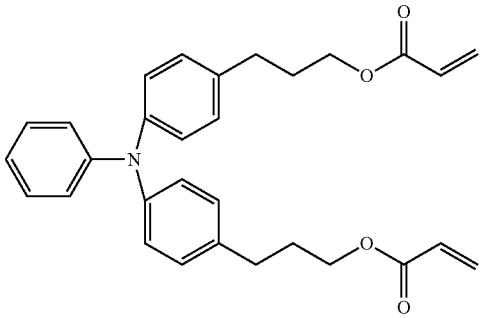

Formation of Surface Layer

The surface layer-forming coating liquid was applied onto the charge transport layer by dip coating, and the coating film was dried at 60° C. for 5 minutes. After being dried, the coating film was irradiated with electron beam radiation at an acceleration voltage of 70 kV and an absorption dose of 8000 Gy for 1.6 s in a nitrogen atmosphere. Then, the coating film was heat-treated in a nitrogen atmosphere for 1 minute under the condition where the coating film temperature came to 130° C. The oxygen concentration was 15 ppm in the steps from the electron beam irradiation to the 1-minute heat treatment. Subsequently, the coating film was heat-treated for 15 minutes in the air under the condition where the coating film temperature came to 110° C., thus yielding a 3 μm-thick surface layer.

Thus, an electrophotographic photosensitive member (OPC-31) was produced which includes the support member, the electroconductive layer, the undercoat layer, the charge generating layer, the charge transport layer, and the surface protective layer in this order.

Example 32

An electrophotographic photosensitive member (OPC-32) was produced in the same manner as in Example 31 except that the amounts of the hole transporting compound represented by formula (H-5) and the non-charge-transporting compound represented by formula (J-1) used for forming the surface layer were varied to 45 parts and 23.5 parts, respectively.

Example 33

An electrophotographic photosensitive member (OPC-33) was produced in the same manner as in Example 31 except that the amounts of the hole transporting compound represented by formula (H-5) and the non-charge-transporting compound represented by formula (J-1) used for forming the surface layer were varied to 35 parts and 33.5 parts, respectively.

Example 34

An electrophotographic photosensitive member (OPC-34) was produced in the same manner as in Example 31 except that the amounts of S-LEC BM-1, the hole transporting compound represented by formula (H-5), and the non-charge-transporting compound represented by formula (J-1), which were used for forming the surface layer, were varied to 3 parts, 55 parts, and 12 parts, respectively.

Example 35

An electrophotographic photosensitive member (OPC-35) was produced in the same manner as in Example 31 except that the amounts of S-LEC BM-1, the hole transporting compound represented by formula (H-5), and the non-charge-transporting compound represented by formula (J-1), which were used for forming the surface layer, were varied to 3 parts, 45 parts, and 22 parts, respectively.

Example 36

An electrophotographic photosensitive member (OPC-36) was produced in the same manner as in Example 31 except that the amounts of S-LEC BM-1, the hole transporting compound represented by formula (H-5), and the non-charge-transporting compound represented by formula (J-1), which were used for forming the surface layer, were varied to 3 parts, 35 parts, and 32 parts, respectively.

Example 37

An electrophotographic photosensitive member (OPC-37) was produced in the same manner as in Example 31 except that the amounts of S-LEC BM-1, the hole transporting compound represented by formula (H-5), and the non-charge-transporting compound represented by formula (J-1), which were used for forming the surface layer, were varied to 4.5 parts, 55 parts, and 10.5 parts, respectively.

Example 38

An electrophotographic photosensitive member (OPC-38) was produced in the same manner as in Example 31 except that the amounts of S-LEC BM-1, the hole transporting compound represented by formula (H-5), and the non-charge-transporting compound represented by formula (J-1), which were used for forming the surface layer, were varied to 4.5 parts, 45 parts, and 20.5 parts, respectively.

Example 39

An electrophotographic photosensitive member (OPC-39) was produced in the same manner as in Example 33 except for using polytetrafluoroethylene particles having an average particle size of 100 nm substituted for the polytetrafluoroethylene particles and zirconia beads of 0.1 mm in diameter substituted for the zirconia beads of 0.3 mm in diameter.

Example 40

An electrophotographic photosensitive member (OPC-40) was produced in the same manner as in Example 36 except for using polytetrafluoroethylene particles having an average particle size of 100 nm substituted for the polytetrafluoroethylene particles and zirconia beads of 0.1 mm in diameter substituted for the zirconia beads of 0.3 mm in diameter.

Comparative Example 3

An electrophotographic photosensitive member (OPC-C3) was produced in the same manner as in Example 31 except that the amounts of the hole transporting compound represented by formula (H-5) and the non-charge-transporting compound represented by formula (J-1) used for forming the surface layer were varied to 32 parts and 36.5 parts, respectively.

Comparative Example 4

An electrophotographic photosensitive member (OPC-C4) was produced in the same manner as in Example 31 except that the amounts of S-LEC BM-1, the hole transporting compound represented by formula (H-5), and the non-charge-transporting compound represented by formula (J-1), which were used for forming the surface layer, were varied to 3 parts, 32 parts, and 35 parts, respectively.

Example 41

An electrophotographic photosensitive member (OPC-41) was produced in the same manner as in Example 31 except that the amounts of the polytetrafluoroethylene particles, the hole transporting compound represented by formula (H-5), and the non-charge-transporting compound represented by formula (J-1), which were used for forming the surface layer, were varied to 20 parts, 55 parts, and 24 parts, respectively.

Example 42

An electrophotographic photosensitive member (OPC-42) was produced in the same manner as in Example 31 except that the amounts of the polytetrafluoroethylene particles, the hole transporting compound represented by formula (H-5), and the non-charge-transporting compound represented by formula (J-1), which were used for forming the surface layer, were varied to 20 parts, 35 parts, and 44 parts, respectively.

Example 43

An electrophotographic photosensitive member (OPC-43) was produced in the same manner as in Example 31 except that the amounts of the polytetrafluoroethylene particles, the hole transporting compound represented by formula (H-5), and the non-charge-transporting compound represented by formula (J-1), which were used for forming the surface layer, were varied to 10 parts, 55 parts, and 34.5 parts, respectively.

Example 44

An electrophotographic photosensitive member (OPC-44) was produced in the same manner as in Example 31 except that the amounts of the polytetrafluoroethylene particles, the hole transporting compound represented by formula (H-5), and the non-charge-transporting compound represented by formula (J-1), which were used for forming the surface layer, were varied to 10 parts, 35 parts, and 54.5 parts, respectively.

Example 45

An electrophotographic photosensitive member (OPC-45) was produced in the same manner as in Example 41 except for using polytetrafluoroethylene particles having an average particle size of 100 nm substituted for the polytetrafluoroethylene particles and zirconia beads of 0.1 mm in diameter substituted for the zirconia beads of 0.3 mm in diameter.

Example 46

An electrophotographic photosensitive member (OPC-46) was produced in the same manner as in Example 42 except for using polytetrafluoroethylene particles having an average particle size of 100 nm substituted for the polytetrafluoroethylene particles and zirconia beads of 0.1 mm in diameter substituted for the zirconia beads of 0.3 mm in diameter.

Example 47

An electrophotographic photosensitive member (OPC-47) was produced in the same manner as in Example 43 except for using polytetrafluoroethylene particles having an average particle size of 100 nm substituted for the polytetrafluoroethylene particles and zirconia beads of 0.1 mm in diameter substituted for the zirconia beads of 0.3 mm in diameter.

Example 48

An electrophotographic photosensitive member (OPC-48) was produced in the same manner as in Example 44 except for using polytetrafluoroethylene particles having an average particle size of 100 nm substituted for the polytetrafluoroethylene particles and zirconia beads of 0.1 mm in diameter substituted for the zirconia beads of 0.3 mm in diameter.

Example 49

An electrophotographic photosensitive member (OPC-49) was produced in the same manner as in Example 41 except for using polytetrafluoroethylene particles having an average particle size of 50 nm substituted for the polytetrafluoroethylene particles and zirconia beads of 0.1 mm in diameter substituted for the zirconia beads of 0.3 mm in diameter.

Example 50

An electrophotographic photosensitive member (OPC-50) was produced in the same manner as in Example 42 except for using polytetrafluoroethylene particles having an average particle size of 50 nm substituted for the polytetrafluoroethylene particles and zirconia beads of 0.1 mm in diameter substituted for the zirconia beads of 0.3 mm in diameter.

Example 51

The layers up to the charge generating layer were formed in the same manner as in Example 1 to form a multilayer structure including the support member. the electroconductive layer, the undercoat layer, and the charge generating layer in this order.

Subsequently, a charge transport layer-forming coating liquid (CTL-51) was prepared for application onto the charge generating layer. This coating liquid was prepared according to the following procedure. First, a polytetrafluoroethylene particle dispersion liquid was prepared for the preparation of coating liquid CTL-51. More specifically, 1.5 parts of a polyvinyl acetal S-LEC BL-10 (produced by Sekisui Chemical, hydroxy group: 28 mol %, butyralization degree: 71 mol %±3 mol %, molecular weight: about 15000) was fully dissolved in the mixed solvent of 48.5 parts of methyl ethyl ketone and 20 parts of N-methylpyrrolidone with stirring. Then, 30 parts of polytetrafluoroethylene particles having an average particle size of 200 nm were added to the solution with stirring to yield a mixture. The polytetrafluoroethylene particles in the mixture were dispersed in a bead mill containing zirconia beads of 0.3 mm in diameter to yield a polytetrafluoroethylene particle dispersion liquid (B-51).

Then, 44 parts of charge transporting material CTM-3, 0.5 part of 2,6-di-tert-butyl-4-methylphenol (BHT), and 55 parts of bisphenol Z polycarbonate resin (PCZ 500, viscosity average particle size: 50000) were dissolved in 400 parts by mass of chlorobenzene to yield a charge transporting material solution. The charge transporting material solution was mixed with dispersion liquid B-51 to yield the charge transport layer-forming coating liquid (CTL-51). In this procedure, the polytetrafluoroethylene particles were added so that the content thereof would become 10% by mass relative to the total mass of CTM-3, BHT, PCZ500, the polytetrafluoroethylene particles, and the polyvinyl acetal in coating liquid CTL-51. The resulting mixture was applied onto the charge generating layer, and the coating was dried at 130° C. for 45 minutes to yield a 36 μm-thick charge transport layer.

Thus, an electrophotographic photosensitive member (OPC-51) was prepared which includes the support member, the electroconductive layer, the undercoat layer, the charge generating layer, and the charge transport layer in this order.

Example 52

A polytetrafluoroethylene particle dispersion liquid (B-51) was prepared in the same manner as in Example 51. Then, in the mixed solvent of 200 parts of dimethoxymethane and 250 parts of cyclopentanone was dissolved 50 parts of a binder resin PS-A that is a polyester resin having the following structure (the l:m:n ratio in the repeating unit: 10:5:5, weight average molecular weight: about 85000):

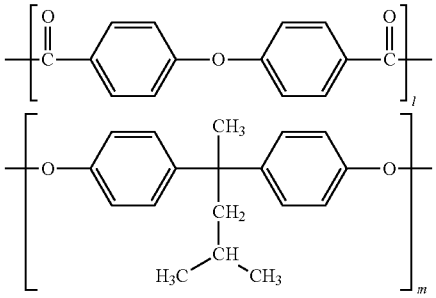

-continued

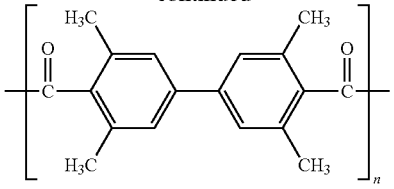

Subsequently, 45 parts of the charge transporting material represented by formula (CTM-1), 5 part of the charge transporting material represented by formula (CTM-2) were further dissolved in the mixed solution to yield a charge transporting material solution. The resulting solution was mixed with dispersion liquid P-51 to yield a charge transport layer-forming coating liquid (CTL-52). In this procedure, the polytetrafluoroethylene particles were added so that the content thereof would become 10% by mass relative to the total mass of CTM-1, CTM-2, PS-A, the polytetrafluoroethylene particles, and the polyvinyl acetal in coating liquid CTL-52. The resulting charge transport layer-forming coating liquid (CTL-52) was applied onto the charge generating layer, and the coating was dried at 130° C. for 45 minutes to yield an 18 μm-thick charge transport layer. Thus, an electrophotographic photosensitive member (OPC-52) was completed.

Example 53

A charge transport layer-forming coating liquid (CTL-53) was prepared in the same manner as in Example 52 except that the binder resin PS-A was replaced with a bisphenol Z polycarbonate resin IUPILON Z400 (bisphenol Z polycarbonate produced by Mitsubishi Engineering-Plastics), and this coating liquid was applied onto the charge generating layer to form a 18 μm-thick charge transport layer containing polytetrafluoroethylene particles and polyvinyl acetal, thus producing an electrophotographic photosensitive member (OPC-53).

Example 54

A charge transport layer-forming coating liquid (CTL-54) was prepared in the same manner as in Example 52 except that the binder resin PS-A was replaced with a polyarylate resin (weight average molecular weight (Mw): 120,000) having the repeating unit represented by the following formula (P-2), and this coating liquid was applied onto the charge generating layer to form an 18 μm-thick charge transport layer containing polytetrafluoroethylene particles and polyvinyl acetal, thus producing an electrophotographic photosensitive member (OPC-54).

(P-2)

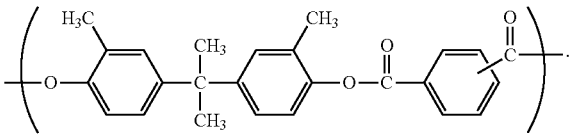

In the polyarylate resin used here, the mole ratio of the terephthalic structure to the isophthalic structure (terephthalic structure:isophthalic structure) was 50:50.

Example 55

A charge transport layer-forming coating liquid (CTL-55) was prepared in the same manner as in Example 51 except for the following:

replacing 44 parts of charge transporting material CTM-3 with the combination of 22 parts of CTM-3 and 22 parts of a charge transporting material CTM-3P represented by the following formula:

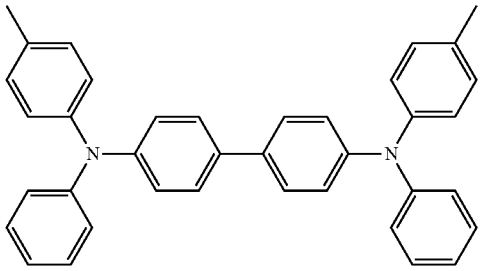

replacing 55 parts of bisphenol Z polycarbonate resin PCZ 500 (viscosity average molecular weight: 50000) with the combination of 40 parts of PCZ 500 and 15 parts of a polycarbonate resin (viscosity average molecular weight: 50000) represented by the following structural formula (PC-X):

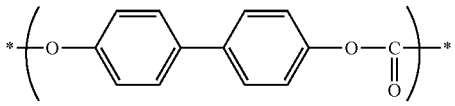

The resulting coating liquid (CTL-55) was applied onto the charge generating layer to form an 18 μm-thick charge transport layer containing polytetrafluoroethylene particles and polyvinyl acetal, thus producing an electrophotographic photosensitive member (OPC-55).

Example 56

A charge transport layer-coating liquid (CTL-56) was prepared in the same manner as in Example 52 except for using polytetrafluoroethylene particles having a primary particle size of 100 nm as the polytetrafluoroethylene particles. This coating liquid was applied onto the charge generating layer to form an 18 μm-thick charge transport layer containing polytetrafluoroethylene particles and polyvinyl acetal, thus producing an electrophotographic photosensitive member (OPC-56).

Example 57

A charge transport layer-coating liquid (CTL-57) was prepared in the same manner as in Example 52 except for using polytetrafluoroethylene particles having a primary particle size of 50 nm as the polytetrafluoroethylene particles. This coating liquid was applied onto the charge generating layer to form an 18 μm-thick charge transport layer containing polytetrafluoroethylene particles and polyvinyl acetal, thus producing an electrophotographic photosensitive member (OPC-57).

Example 58

An electrophotographic photosensitive member (OPC-58) was produced in the same manner as in Example 52 except for the preparation of the polytetrafluoroethylene particle dispersion liquid. In this preparation, the combination of 1.5 parts of polyvinyl acetal, 48.5 parts of methyl ethyl ketone and 20 parts of N-methylpyrrolidone was replaced with the combination of 3 parts of polyvinyl acetal, 44 parts of cyclohexanone and 20 parts of N,N-dimethylacetamide.

Example 59

An electrophotographic photosensitive member (OPC-59) was produced in the same manner as in Example 52 except for the preparation of the polytetrafluoroethylene particle dispersion liquid. In this preparation, the combination of 1.5 parts of polyvinyl acetal, 48.5 parts of methyl ethyl ketone and 20 parts of N-methylpyrrolidone was replaced with the combination of 0.9 part of polyvinyl acetal, 49.1 parts of cyclohexanone and 20 parts of N,N-dimethylacetamide.

Example 60

An electrophotographic photosensitive member (OPC-60) was produced in the same manner as in Example 52 except for the preparation of the polytetrafluoroethylene particle dispersion liquid. In this preparation, the combination of 1.5 parts of polyvinyl acetal, 48.5 parts of methyl ethyl ketone and 20 parts of N-methylpyrrolidone was replaced with the combination of 0.3 part of polyvinyl acetal, 49.7 parts of cyclohexanone and 20 parts of N,N-dimethylacetamide.

Example 61

An electrophotographic photosensitive member (OPC-61) was produced in the same manner as in Example 52 except for the preparation of the polytetrafluoroethylene particle dispersion liquid. In this preparation, the combination of 1.5 parts of polyvinyl acetal, 48.5 parts of methyl ethyl ketone and 20 parts of N-methylpyrrolidone was replaced with the combination of 4.5 parts of polyvinyl acetal, 45.5 parts of cyclohexanone and 20 parts of N,N-dimethylacetamide.

Evaluation

Feeding Durability Test of Electrophotographic Photosensitive Member

Each of the electrophotographic photosensitive member samples OPC-1 to OPC-61 and OPC-C1 to OPC-C4 was mounted in a laser beam printer Color LaseJet Enterprise M552 manufactured by Hewlett-Packard and subjected to a durability test performed while feeding printing paper at a normal temperature of 23° C. and a low relative humidity of 5%. In this feeding durability test, character patterns were printed with a print coverage of 2% on 5000 letter sheets in an intermittent mode in which printed sheets were outputted one by one.

The charged potential (dark portion potential) and the potential when exposed to light (bright portion potential) were measured before starting the durability test and after 5000-sheet output. For the potential measurement, a white solid pattern sheet and a black solid pattern sheet were used. The initial dark portion potential is represented as Vd and the initial bright portion potential is represented as Vl (each at the beginning of durability test). The dark portion potential after 5000-sheet output is represented as Vd', and the bright portion potential after 5000-sheet output is represented as Vl'. The variation ΔVl in bright portion potential (=|Vl'−Vl|), representing the difference between the bright portion potential Vl' after 5000-sheet output and the initial bright portion potential Vl was calculated.

The results are shown in the Table below.

Test of Electrophotographic Photosensitive Members for Printed Pattern Definition (Discrete Dots)

A laser beam printer Color Laser Jet Enterprise M552 manufactured by Hewlett-Packard was modified as below for examination for the definition of the printed pattern. More specifically, the printer was modified so that the charging conditions and the amount of laser exposure could be varied. Also, the printer was modified so as to be operable in a state where the black process cartridge on which any of the above-prepared electrophotographic photosensitive members OPC-1 to OPC-61 and OPC-C1 to OPC-C4 was mounted was attached to the station of the black process cartridge of the printer without the process cartridges for the other colors (cyan, magenta, and yellow) attached to their stations. For outputting image patterns, only the black process cartridge was mounted to the laser beam printer, and black single-color patterns were output. The laser beam intensity was adjusted so that the dark portion potential Vd would be −600 V; the bright portion potential Vl would be −250 V; and the developing bias Vdc applied to the charging member would be −450 V.

The definition of output image patterns was evaluated based on the density of an output image pattern of dots formed by exposure at intervals each corresponding to three dots at a normal temperature of 23° C. and a low humidity of 5%. The density of an output pattern was calculated from the difference in whiteness of the output pattern between the exposed dot portions and the unexposed dot portions (white portions). The density of output image patterns was measured with a white light photometer (TC-6DS/A, manufactured by Tokyo Denshoku, using an umber filter).

If a latent image of the discrete dot pattern has been formed clearly on the electrophotographic photosensitive member, the discrete dots are clearly output on a paper sheet, and thus, a high-density image is outputted. If a latent image of the discrete dot pattern has not been formed clearly on the electrophotographic photosensitive member, the discrete dots are not clearly output on a paper sheet, and thus, a low-density image is outputted. Thus, the definition of outputted image patterns can be evaluated based on how high or low the density of the output image pattern is. When the density of the outputted image pattern was 8.0% or more, it was determined that exposed dots were clearly reproduced.

TABLE

| | | Test Result | |
|---|---|---|---|
| Example | Electrophotographic photosensitive member | Feeding durability test \|ΔVl\| (V) | Discrete dot pattern test: Outputted image density (%) |
| Example 1 | OPC-1 | 20 | 10.2 |
| Example 2 | OPC-2 | 24 | 10 |
| Example 3 | OPC-3 | 22 | 10.2 |
| Example 4 | OPC-4 | 22 | 10.2 |
| Example 5 | OPC-5 | 25 | 10.2 |
| Example 6 | OPC-6 | 24 | 9.5 |
| Example 7 | OPC-7 | 19 | 10.5 |

TABLE-continued

| Example | Electrophotographic photosensitive member | Test Result: Feeding durability test \|ΔVI\| (V) | Test Result: Discrete dot pattern test: Outputted image density (%) |
|---|---|---|---|
| Example 8 | OPC-8 | 23 | 10.3 |
| Example 9 | OPC-9 | 21 | 10.5 |
| Example 10 | OPC-10 | 21 | 10.5 |
| Example 11 | OPC-11 | 22 | 10.5 |
| Example 12 | OPC-12 | 23 | 9.8 |
| Example 13 | OPC-13 | 18 | 10.8 |
| Example 14 | OPC-14 | 22 | 10.6 |
| Example 15 | OPC-15 | 20 | 10.8 |
| Example 16 | OPC-16 | 20 | 10.8 |
| Example 17 | OPC-17 | 21 | 10.8 |
| Example 18 | OPC-18 | 24 | 10 |
| Example 19 | OPC-19 | 22 | 9.9 |
| Example 20 | OPC-20 | 26 | 9.7 |
| Example 21 | OPC-21 | 24 | 9.9 |
| Example 22 | OPC-22 | 24 | 9.9 |
| Example 23 | OPC-23 | 26 | 9.9 |
| Example 24 | OPC-24 | 26 | 9 |
| Example 25 | OPC-25 | 22 | 10.2 |
| Example 26 | OPC-26 | 21 | 10.5 |
| Example 27 | OPC-27 | 20 | 10.8 |
| Example 28 | OPC-28 | 24 | 9.9 |
| Example 29 | OPC-29 | 22 | 10.1 |
| Example 30 | OPC-30 | 20 | 10.7 |
| Comparative Example 1 | OPC-C1 | 31 | 7.9 |
| Comparative Example 2 | OPC-C2 | 37 | 7.8 |
| Example 31 | OPC-31 | 20 | 10.2 |
| Example 32 | OPC-32 | 23 | 10.2 |
| Example 33 | OPC-33 | 26 | 10.2 |
| Example 34 | OPC-34 | 22 | 10.2 |
| Example 35 | OPC-35 | 25 | 10.2 |
| Example 36 | OPC-36 | 27 | 10.2 |
| Example 37 | OPC-37 | 24 | 10.2 |
| Example 38 | OPC-38 | 28 | 10.2 |
| Example 39 | OPC-39 | 26 | 10.5 |
| Example 40 | OPC-40 | 27 | 10.5 |
| Comparative Example 3 | OPC-C3 | 39 | 8.5 |
| Comparative Example 4 | OPC-C4 | 45 | 8.5 |
| Example 31 | OPC-41 | 19 | 10.2 |
| Example 32 | OPC-42 | 25 | 10.2 |
| Example 33 | OPC-43 | 18 | 10.2 |
| Example 34 | OPC-44 | 24 | 10.2 |
| Example 35 | OPC-45 | 19 | 10.5 |
| Example 36 | OPC-46 | 25 | 10.5 |
| Example 37 | OPC-47 | 18 | 10.5 |
| Example 38 | OPC-48 | 24 | 10.5 |
| Example 39 | OPC-49 | 19 | 10.8 |
| Example 40 | OPC-50 | 25 | 10.8 |
| Example 51 | OPC-51 | 18 | 10.1 |
| Example 52 | OPC-52 | 18 | 10.1 |
| Example 53 | OPC-53 | 18 | 10.1 |
| Example 54 | OPC-54 | 18 | 10.1 |
| Example 55 | OPC-55 | 18 | 10.1 |
| Example 56 | OPC-56 | 19 | 10.5 |
| Example 57 | OPC-57 | 18 | 10.8 |
| Example 58 | OPC-58 | 18 | 10.2 |
| Example 59 | OPC-59 | 18 | 10.1 |
| Example 60 | OPC-60 | 20 | 10 |
| Example 61 | OPC-61 | 22 | 9.8 |

While the present disclosure has been described with reference to exemplary embodiments, it is to be understood that the disclosure is not limited to the disclosed exemplary embodiments. The scope of the following claims is to be accorded the broadest interpretation so as to encompass all such modifications and equivalent structures and functions.

This application claims the benefit of Japanese Patent Application No. 2017-127999 filed Jun. 29, 2017, which is hereby incorporated by reference herein in its entirety.

What is claimed is:

1. An electrophotographic photosensitive member comprising: an electroconductive support member; and a photosensitive layer on or above the electroconductive support member, wherein a surface layer constituting an uppermost layer of the electrophotographic photosensitive member contains polytetrafluoroethylene particles, a charge transporting material, and polyvinyl acetal, a content of the polyvinyl acetal with respect to the polytetrafluoroethylene particles is in the range of 0.1% by mass to 15.0% by mass, and a content of the charge transporting material with respect to a total mass of the surface layer is 35% by mass or more, and wherein the polytetrafluoroethylene particles are coated with the polyvinyl acetal.

2. The electrophotographic photosensitive member according to claim 1, wherein the proportion of the polyvinyl acetal content to the polytetrafluoroethylene particles content in the surface layer is in the range of 3.0% by mass to 12.0% by mass.

3. The electrophotographic photosensitive member according to claim 1, wherein the polytetrafluoroethylene particles have an average primary particle size in the range of 50 nm to 100 nm.

4. The electrophotographic photosensitive member according to claim 1, wherein the charge transporting material content in the surface layer is 60% by mass or more relative to the total mass of the surface layer.

5. A process cartridge capable of being removably attached to an electrophotographic apparatus, the process cartridge comprising:

an electrophotographic photosensitive member; and at least one device selected from the group consisting of a charging device, a developing device, a transfer device, and a cleaning device, the at least one device being held together with the electrophotographic photosensitive member in one body, wherein the electrophotographic photosensitive member comprises:

an electroconductive support member; and a photosensitive layer on or above the electroconductive support member, wherein a surface layer constituting an uppermost layer of the electrophotographic photosensitive member contains polytetrafluoroethylene particles, a charge transporting material, and polyvinyl acetal, a content of the polyvinyl acetal with respect to the polytetrafluoroethylene particles is in the range of 0.1% by mass to 15.0% by mass, and a content of the charge transporting material with respect to a total mass of the surface layer is 35% by mass or more, and wherein the polytetrafluoroethylene particles are coated with the polyvinyl acetal.

6. An electrophotographic apparatus comprising:

an electrophotographic photosensitive member;

a charging device;

an exposure device;

a developing device; and a transfer device, wherein the electrophotographic photosensitive member comprises:

an electroconductive support member; and a photosensitive layer on or above the electroconductive support member, wherein a surface layer constituting an uppermost layer of the electrophotographic photosensitive member contains polytetrafluoroethylene particles, a charge transporting material, and polyvinyl acetal, a content of the polyvinyl acetal with respect to the polytetrafluoroethylene particles is in the range of 0.1% by mass to 15.0% by mass, and a content of the charge transporting material with respect to a total mass of the surface layer is 35% by mass or more, and wherein the polytetrafluoroethylene particles are coated with the polyvinyl acetal.

* * * * *